US006712454B2

(12) United States Patent
Okuda

(10) Patent No.: US 6,712,454 B2
(45) Date of Patent: Mar. 30, 2004

(54) INK JET RECORDING HEAD AND INK JET RECORDING APPARATUS

(75) Inventor: Masakazu Okuda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/280,064

(22) Filed: Oct. 25, 2002

(65) Prior Publication Data

US 2003/0098901 A1 May 29, 2003

(30) Foreign Application Priority Data

Oct. 26, 2001 (JP) ..... 2001-328765

(51) Int. Cl.[7] ..... B41J 2/05; B41J 2/045
(52) U.S. Cl. ..... 347/65; 347/71
(58) Field of Search ..... 347/20, 56, 63, 347/67, 70, 71

(56) References Cited

U.S. PATENT DOCUMENTS

| | | | | |
|---|---|---|---|---|
| 5,818,482 A | * | 10/1998 | Ohta et al. | 347/70 |
| 6,134,761 A | * | 10/2000 | Usui | 347/71 |
| 2002/0175976 A1 | | 11/2002 | Okuda | 347/71 |

FOREIGN PATENT DOCUMENTS

| | | | |
|---|---|---|---|
| JP | 53-12138 | 2/1978 | E04H/9/02 |
| JP | 1-208146 | 8/1989 | B41J/3/04 |
| JP | 10-193587 | 7/1998 | B41J/2/01 |
| WO | WO 97/28000 | 8/1997 | B41J/2/045 |

* cited by examiner

*Primary Examiner*—Juanita Stephens
(74) *Attorney, Agent, or Firm*—Morgan, Lewis & Bockius LLP

(57) ABSTRACT

An ink jet recording head has a plurality of ejectors and an ink supply system. Each of the plurality of ejectors has a pressure generating chamber, a nozzle communicating with the pressure generating chamber, and a pressure generating portion. The ejectors are arrayed two-dimensionally. The ink supply system has a common flow path with which a plurality of the ejectors are interconnected. The pressure generating chambers are filled with ink through the common flow path. A change of pressure is generated in the ink in the pressure generating chambers by the pressure generating portions. Thus, ink droplets are ejected from the nozzles. The common flow path is disposed to overlap the pressure generating chambers two-dimensionally. The common flow path has a constricted shape having wide portions and narrow portions.

17 Claims, 25 Drawing Sheets

INK JET RECORDING HEAD AND INK JET RECORDING APPARATUS

The present disclosure relates to the subject matter contained in Japanese Patent Application No. 2001-328765 filed on Oct. 26, 2002, which is incorporated herein by reference in its entirety.

BACKGROUND OF THE INVENTION

1. Field of the Invention

The present invention relates to an ink jet recording head and an ink jet recording apparatus in which ink droplets are ejected from nozzles so as to record characters or graphics.

2. Description of the Related Art

Drop-on-demand type ink jet systems are generally known well (JP-A-Hei.53-12138 and JP-A-Hei.10-193587). In the drop-on-demand type ink jet systems, a pressure generating member such as a piezoelectric actuator is used to generate a pressure wave (acoustic wave) in a pressure generating chamber filled with ink, so that an ink droplet is ejected from a nozzle communicating with the pressure generating chamber by the pressure wave.

FIG. 23 shows an example of an ejector in an ink jet recording apparatus known in these official gazettes. An ejector 10 is constituted by a common flow path 4, an air damper 26, an ink supply path 5, a diaphragm plate 8, a piezoelectric actuator 3, a pressure generating chamber 1 and a nozzle 2. Generally, one ejector 10 has one nozzle 2. Generally, one ejector 10 has one nozzle 2. The nozzle 2 for ejecting ink and the ink supply path 5 for introducing ink from an ink tank (not shown) through the common flow path 4 communicate with the pressure generating chamber 1. The air damper 26 is provided on the common flow path 4 so as to absorb the pressure. In addition, the diaphragm plate 6 is provided on the bottom surface of the pressure generating chamber 1, and the piezoelectric actuator 7 is attached to the outside of the diaphragm plate 6.

To eject an ink droplet 8, the piezoelectric actuator 7 displaces the diaphragm plate 6 to change the volume of the pressure generating chamber 1 to thereby generate a pressure wave. By this pressure wave, a part of ink charged into the pressure generating chamber 1 is jetted to the outside through the nozzle 2 so as to fly as the ink droplet 8. The flying ink droplet 8 lands on a recording medium such as a recording paper so as to form a recording dot. Such a recording dot is formed repeatedly in accordance with image data. Thus, characters or graphics are recorded on the recording medium.

FIG. 24 schematically show the meniscus operation of the nozzle 2 before and after ejecting the ink droplet 8. As shown in FIG. 24A, a meniscus 9 is substantially flat initially. When the pressure generating chamber 1 is compressed, the meniscus 9 moves toward the outside of the nozzle 2 so as to eject the ink droplet 8 (FIG. 24B). Immediately after the ink droplet 8 is ejected, the ink volume inside the nozzle 2 is reduced so that the meniscus 9 is formed into a concave shape (FIG. 24C). The value y shown in FIG. 24C designates the displacement of the meniscus 9 after the ejection. The concave meniscus 9 undergoes the states shown in FIGS. 24D and 24E by the effect of the surface tension of the ink, and returns to the opening portion of the nozzle 2 gradually. Thus, in a short time, the meniscus 9 recovers its condition before the ejection (FIG. 24F).

FIG. 25 shows the positional change of the meniscus 9 immediately after the ejection of the ink droplet 8. The meniscus 9 making a large retreat (y=−60 $\mu$m) immediately after the ejection (t=0) returns to its initial position (y=0) while swinging as shown in FIG. 25. The return behavior of the meniscus 9 after the ejection of the ink droplet 8 is referred to as "refill", and time for the meniscus 9 to return to the opening surface of the nozzle 2 for the first time after the ejection of the ink droplet 8 is referred to as "refill time" ($t_r$).

In ink jet recording heads, the number of nozzles 2 is a parameter having the greatest influence on the recording speed. As the number of the nozzles 2 is increased, the number of dots that can be formed per unit time is increased so that the recording speed can be enhanced. Therefore, in a typical ink jet recording apparatus, a multi-nozzle type recording head in which a plurality of ejectors 10 have been interconnected one another is often adopted. FIG. 26 shows a recording head in which ejectors 10 are aligned one-dimensionally. The recording head is constituted by an ink tank 20, ink conduits 18*a* and 18*b*, a filter 19 and the ejectors 10. The ink tank 20 is connected to a common flow path 4 through the ink conduits 18*a* and 18*b* and the filter 19. The plurality of ejectors 10 communicate with the common flow path 4.

However, in such a structure in which the ejectors 10 are aligned one-dimensionally, the number of the ejectors 10 cannot be increased much. It is said that the upper limit of the number of ejectors 10 is typically about 100. Therefore, some ink jet recording heads in which the number of ejectors is increased by arraying ejectors two-dimensionally in a matrix (hereinafter, referred to as "matrix-array head") have been heretofore proposed (JP-A-Hei.1-208146, JP-A-Hei.10-508808, etc.).

FIG. 27 shows an example of a matrix-array head. The matrix-array head differs from the recording head in FIG. 26 in that a second common flow path 16 is provided newly and there are a plurality of common flow paths 4. Each of common flow paths 4 communicate with the second common flow path 16, and a plurality of ejectors 10 are connected to each of the common flow paths 4. Such a matrix-array head structure is very effective in increasing the number of ejectors 10. For example, when the number of common flow paths 4 is set at 26 and 10 ejectors 10 are connected to each of the common flow paths 4, 260 ejectors 10 can be arrayed.

FIG. 28 shows an ink jet recording head disclosed in JP-A-Hei.10-508808. FIG. 28A shows the section of ejectors 10, and FIG. 28B shows the schematic arrangement of the ejectors 10. As shown in FIG. 28A, the ink jet recording head is constituted by pressure generating chambers 1, nozzles 2, communication paths 3, ink supply paths 5, a diaphragm plate 6, piezoelectric actuators 7 and flow paths 23. This ink jet recording head is formed by laminating a nozzle plate 11, a flow path plate 25 and the diaphragm plate 6 to one another. Partition walls 27 are thick enough not to transmit the pressure in the pressure generating chambers 1 to the flow paths 23. As shown in FIG. 28B, the flow paths 23 communicate with the flow paths 24. The flow paths 23 correspond to the common flow paths 4 in FIG. 27, and the flow paths 24 correspond to the second common flow path 16.

In the related-art matrix-array heads as shown in FIGS. 27 and 28, however, there are some problems. As for the first problem, the interval (nozzle pitch Pc) of nozzles 2 having a common flow path 4 therebetween cannot be set to be small. As a result, the array density of the ejectors 10 (the number of nozzles per unit area) cannot be made very high.

FIG. 29 shows an equivalent electric circuit of the matrix-array head. The signs m, r, c, and Φ designate inertance [kg/m$^4$], acoustic resistance [Ns/m$^5$], acoustic capacitance [m$^5$/N] and pressure [Pa], respectively, and suffixes d, c, i, n, p and p' designate a driving portion, a pressure generating chamber, an ink supply path, a nozzle, a common flow path and a second common flow path, respectively. In the matrix-array head having the ejectors 10 arrayed two-dimensionally, as shown in FIG. 29, a large number of ejectors 10 communicate with one another through the common flow paths 4 and the second common flow path 16. Therefore, when the number of ejectors 10 communicating with one and the same common flow path 4 is large, it is necessary to suppress crosstalk (pressure interference) or the like between the ejectors 10 close to each other. It is, therefore, necessary to secure a large acoustic capacitance in the common flow path 4.

However, as will be described later, in order to increase the acoustic capacitance of the common flow path 4, it is necessary to set the width of the common flow path 4 to be large. Accordingly, in the related-art matrix-array heads, the nozzle pitch Pc between the nozzles 2 opposed to each other through the common flow path 4 becomes so large that the nozzles 2 cannot be arrayed with high density.

Further, as the second problem in the related-art matrix-array heads, the ejection condition becomes unstable when large-diameter ink droplets 8 are ejected concurrently from a plurality of ejectors 10 in a short period (high-frequency concurrent ejection) from a plurality of ejectors 10. FIG. 30 shows an example of results of testing about the stability of ejection using a related-art matrix-array head, in which the droplet volume of each ink droplet 8 and the ejecting frequency thereof were varied. A designates the result when the ink droplet volume was 20 pl, and B designates the result when the ink droplet volume was 30 pl. Incidentally, the stability of ejection was evaluated as a change of the flying speed (droplet speed) of the ink droplet 8.

As shown in the graph A, when ink droplets each having a droplet volume of 20 pl were ejected concurrently from 260 ejectors 10 arrayed in a matrix, it was confirmed that the droplet speed became unstable at the ejecting frequency of 10 kHz or higher, and the droplets could not be ejected at the ejecting frequency of 15 kHz or higher. The ejecting condition of ink droplets 8 at that time was observed stroboscopically. As a result, the ejecting condition that large-diameter droplets and small-diameter droplets were ejected alternately was often observed at the ejecting frequency of 10 kHz or higher, and the case where the droplet diameter or the droplet speed changed at random was also observed. In addition, when the droplet volume was increased to 30 pl, similar unstable ejection was observed at the ejecting frequency of 7 kHz or higher as shown in the graph B.

As a result of the experimental evaluation, it was found that the phenomenon that the ejection became unstable was apt to occur when the number of ejectors 10 serving for concurrent ejection was large, when the ejecting frequency was high, or when the diameter of ink droplets 8 to be ejected was large. In addition, it was confirmed that when unstable ejection occurred, all the ejectors 10 connected to the same common flow path 4 became unstable in the substantially same manner. From the result of such observation, it can be said that the phenomenon of unstable ejection is not caused by acoustic crosstalk among the ejectors 10 but is a new phenomenon of unstable ejection that has never been brought into question in the related art.

When such an unstable ejection phenomenon occurs, the droplet volume or the droplet speed of the ink droplets 8 becomes very unstable so that the quality of an output image is degraded on a large scale. In addition, when the degree of instability is conspicuous, bubbles may be involved in the nozzles 2 so as to inhibit ejection. Since such an unstable ejection phenomenon occurs, the related-art matrix-array heads cannot eject large-diameter ink droplets 8 concurrently from a large number of ejectors 10 at a high frequency. Thus, the related-art matrix-array heads cannot sufficiently exert their feature that the matrix-array heads are advantageous to high speed recording.

SUMMARY OF THE INVENTION

It is an object of the present invention to provide a matrix-array head which can be produced with a high nozzle array density and at low manufacturing cost, and further in which an unstable ejection phenomenon occurring when large-diameter ink droplets are ejected concurrently from a plurality of ejectors at a high frequency is suppressed so that stable, high-speed recording can be carried out.

The present inventor made various researches in order to prevent crosstalk from occurring among ejectors in ink jet recording heads. As a result of the researches, the inventor obtained the following finding and achieved the invention. Here, there is a close relationship between the acoustic capacitance of a common flow path 4 and the width of the common flow path 4. When the rigidity of the common flow path wall is high, the acoustic capacitance $c_v$ of the common flow path 4 is expressed by the following equation.

$$c_v = V_p/(\kappa \cdot K_r) \tag{1}$$

where $V_p$ designates the volume [m$^3$] of the common flow path 4, κ designates the elastic coefficient [Pa] of ink, and $K_r$ designates a correction coefficient depending on the rigidity of the common flow path wall, which is typically a value of about 0.3–0.7. The acoustic capacitance of the common flow path 4 is proportional to the volume $V_p$ of the common flow path. Since there is an upper limit on the height of the common flow path 4 (typically about 100–200 μm), the width of the common flow path 4 has to be set to be large enough to secure a large acoustic capacitance (volume).

In addition, when an air damper 26 having a small rigidity is added to a part of the common flow path 4 as shown in FIG. 23, the acoustic capacitance of the common flow path 4 may be also increased. In this case, the acoustic capacitance $c_d$ added to the common flow path 4 by the air damper 26 can be calculated by:

$$c_d = \frac{l_d W_d^5 (1 - \nu_d^2)}{60 E_d t_d^3} \tag{2}$$

where $W_d$ [m] designates the width of the air damper, $t_d$ [m] designates the thickness of the air damper, $l_d$ [m] designates the length of the air damper, $E_d$ [Pa] designates the elastic coefficient of the air damper, and $\nu_d$ designates the Poisson's ratio of the air damper. That is, the acoustic capacitance $c_d$ added by the air damper 26 is proportional to the fifth power of the air damper width $W_d$. In the ink jet recording head shown in FIG. 23, the width of the air damper 26 is equal to the width of the common flow path 4. In order to set the acoustic capacitance $c_d$ at a large value, the width of the common flow path 4 has to be set to be large. The total acoustic capacitance $c_p$ of the common flow path is a value of the sum of $c_v$ and $c_d$.

As described above, in order to secure a large acoustic capacitance in the common flow path 4, it is necessary to set the width of the common flow path 4 to be large. However, in order to secure a large width in the common flow path 4 in the related-art matrix-array head as shown in FIG. 28, it is necessary to set the nozzle pitch $P_c$ to be very large to thereby bring about reduction in the nozzle array density inevitably. That is, in the related-art matrix-array head as shown in FIG. 28, in which common flow paths are formed into straight lines, the nozzle pitch $P_c$ has to be set to satisfy the following expression because of its structural requirements.

$$P_c \geqq W_p + d_T + 2W_{W1} \quad (3)$$

where WP designates the required width of the flow path 23, $d_T$ designates the diameter of the communication path 3, and $W_{W1}$ designates the width of the partition wall between the communication path 3 and the flow path 23. This is because the communication path 3 is formed in the same plane as the flow path 23 in this matrix-array head, and both the communication path 3 and the flow path 23 have to be separated from each other by the partition wall 27.

The communication path 3 is required to have a function to introduce ink into the nozzle 2 in low fluid resistance while stabilizing the direction in which the ink droplet 8 is ejected. To this end, the communication path 3 has to have a certain large diameter. The diameter is about 100–150 μm in a typical ink jet recording head. In addition, the partition wall 27 between the communication path 3 and the flow path 23 needs a certain width to secure a joint to the nozzle plate or the like. For example, when the flow path plate 25 and the nozzle plate 11 are joined to each other by a bonding agent, a failure in bonding is apt to occur when the width of the partition wall 27 is set to be smaller than 100 μm. When there occurs a failure in bonding, a pressure wave leaks between the communication path 3 and the flow path 23. Thus, there arises such a problem that the pressure wave cannot be generated normally. Since each of the communication path diameter $d_T$ and the partition wall width $W_{W1}$ has to be not smaller than a predetermined value, it is difficult to set the nozzle pitch $P_c$ to be small enough to attain a high nozzle array density in related-art matrix-array heads having straight flow paths 23.

On the basis of the finding, an ink jet recording head according to the invention includes: a plurality of ejectors arrayed two-dimensionally, each including a pressure generating chamber, a nozzle communicating with the pressure generating chamber, and a pressure generating portion; and an ink supply system including a common flow path for interconnecting a plurality of the ejectors therewith. The ink jet recording head has a feature in that: ink is charged into the pressure generating chambers through the common flow path; a change of pressure is produced in the ink in the pressure generating chambers by the pressure generating portions corresponding thereto and ink droplets are ejected from the nozzles; the common flow path is disposed to overlap the pressure generating chambers two-dimensionally; and the common flow path has a constricted shape having wide portions and narrow portions.

As for the constricted shape, it is preferable that the common flow path is set to be narrow between the nozzles opposed to each other through the common flow path and wide in any other portion. In the ink jet recording head according to the invention, the common flow path is formed into a constricted shape so that the width of the common flow path is enlarged partially. Accordingly, sufficient acoustic capacitance can be secured in spite of the nozzle pitch $P_c$ set to be smaller than that in the related-art head. In the ink jet recording head according to the invention, the nozzle pitch $P_c$ can be set to be in the following range:

$$P_c \geqq W_1 + W_{W2} \quad (4)$$

where $W_1$ designates the width of the common flow path and $W_{W2}$ designates the partition wall width between the common flow paths (see FIG. 5). The partition wall width $W_{W2}$ takes a value substantially equal to the partition wall width $W_{W1}$. However, pressure wave leakage between the common flow paths causes no great problem on the ejection characteristic. It is therefore possible to set the partition wall width $W_{W2}$ to be smaller than the partition wall width $W_{W1}$. That is, in the ink jet recording head according to the invention, the nozzle pitch $P_c$ can be reduced by at least $(d_T+W_{W1})$ in comparison with the related-art matrix-array head. Thus, the nozzle array density can be increased on a large scale.

In addition, the ink jet recording head according to the invention has a feature in that a member forming the nozzles also has a function as an air damper for the common flow path.

With this feature, the air damper for the common flow path can be formed out of a reduced number of members, so that there can be obtained an effect that an ink jet recording head having a high nozzle array density can be produced at low manufacturing cost.

In addition, in the ink jet recording head according to the invention, the member forming the nozzles is made of a resin film.

In this manner, large acoustic capacitance can be secured in the air damper so that required acoustic capacitance can be obtained in the narrower common flow path. Thus, the nozzle array density can be increased further.

In addition, in the ink jet recording head according to the invention, the acoustic capacitance $c_p$ of the common flow path is set to satisfy the following conditional expression:

$$c_p > 20c_c$$

In this manner, acoustic crosstalk among the ejectors can be prevented from occurring, so that there can be obtained an effect that an ink jet recording head whose ejecting characteristic is high in uniformity and stability can be produced.

In addition, in the ink jet recording head according to the invention, the acoustic capacitance $c_p$ of the common flow path is set to satisfy the following conditional expression:

$$c_p > 10c_n$$

In this manner, refill time at the time of concurrent ejection from a plurality of ejectors can be prevented from increasing, so that there can be obtained an effect that the uniformity and the stability in the ejecting characteristic can be improved further.

In addition, in the ink jet recording head according to the invention, flow path resistance of the ink supply system is set so that refill time when ink droplets are ejected continuously from the nozzles is prevented from being longer than an intended ejection period due to a drop in pressure in the common flow path caused by a quasi-stationary ink flow in the ink supply system.

Further, the flow path resistance of the ink supply system is set so that the drop in pressure in the common flow path when ink droplets are ejected continuously from the nozzles is not higher than 800 Pa.

In this manner, an unstable ejection phenomenon appearing when large-diameter ink droplets are ejected concurrently from a plurality of ejectors at a high frequency can be suppressed. Thus, it is possible to produce an ink jet recording head suitable for high speed recording.

In addition, in the ink jet recording head according to the invention, a planar shape of the common flow path corresponding to the constricted shape is formed out of a smooth curve.

In this manner, the flow of ink in the common flow path is made so uniform that bubbles can be prevented from staying in the common flow path. Thus, it is possible to produce an ink jet recording head which is high in reliability.

In addition, in the ink jet recording head according to the invention, the ink supply system includes a plurality of common flow paths; and a second common flow path for interconnecting a plurality of the common flow paths with one another.

In this manner, ink can be supplied efficiently to a large number of ejectors, so that there can be obtained an effect that the size of the head as a whole can be reduced.

In addition, in the ink jet recording head according to the invention, an ink supply port for supplying ink to the second common flow path is provided near the center of the second common flow path.

In this manner, required width of the second common flow path can be reduced, so that there can be obtained an effect that the head size can be reduced.

In addition, in the ink jet recording head according to the invention, a plurality of ink supply ports for supplying ink to the second common flow path are provided in the second common flow path.

In this manner, required width of the second common flow path can be reduced. Thus, it is possible to produce an ink jet recording head in which the head size can be reduced, while the ink jet recording head is hardly affected by clogging of the flow paths with dust or the like.

In addition, in the ink jet recording head according to the invention, a plurality of second common flow paths are provided.

In this manner, the required width of the second common flow paths can be reduced. Thus, there can be obtained effects that the head size can be reduced and bubbles can be prevented from staying in the second common flow paths.

In addition, in the ink jet recording head according to the invention, the common flow paths are disposed substantially in parallel with a main-scanning direction of the ink jet recording head, and the second common flow path is disposed substantially perpendicularly to the main-scanning direction.

In this manner, the total head length in the sub-scanning direction can be set to be short. Thus, there can be obtained an effect that the distance between rollers for conveying a recording medium is set to be so short that the conveyance of the recording medium can be stabilized.

In addition, in the ink jet recording head according to the invention, the common flow paths are disposed substantially perpendicularly to a main-scanning direction of the ink jet recording head; and the second common flow path is disposed substantially in parallel with the main-scanning direction.

In this manner, the total head width in the main-scanning direction can be set to be short, so that it is possible to produce an ink jet recording head more advantageous to high speed recording.

In addition, in the ink jet recording head according to the invention, the plurality of common flow paths are divided into two or more groups, and the respective groups of the common flow paths are connected to the second common flow paths different from one another.

In this manner, the required sectional area of the common flow paths and/or the required sectional area of the second common flow path can be reduced, so that there can be obtained an effect that the nozzle array density can be further increased.

An ink jet recording apparatus according to the invention has a feature in that the ink jet recording apparatus has such an ink jet recording head.

According to such an ink jet recording apparatus, it is possible to produce an ink jet recording apparatus having an extremely high recording speed.

DETAILED DESCRIPTION OF THE PREFERRED EMBODIMENTS

The invention will be described below in further detail with reference to the drawings and on the basis of embodiments of the invention.

First Embodiment

Figure 1:
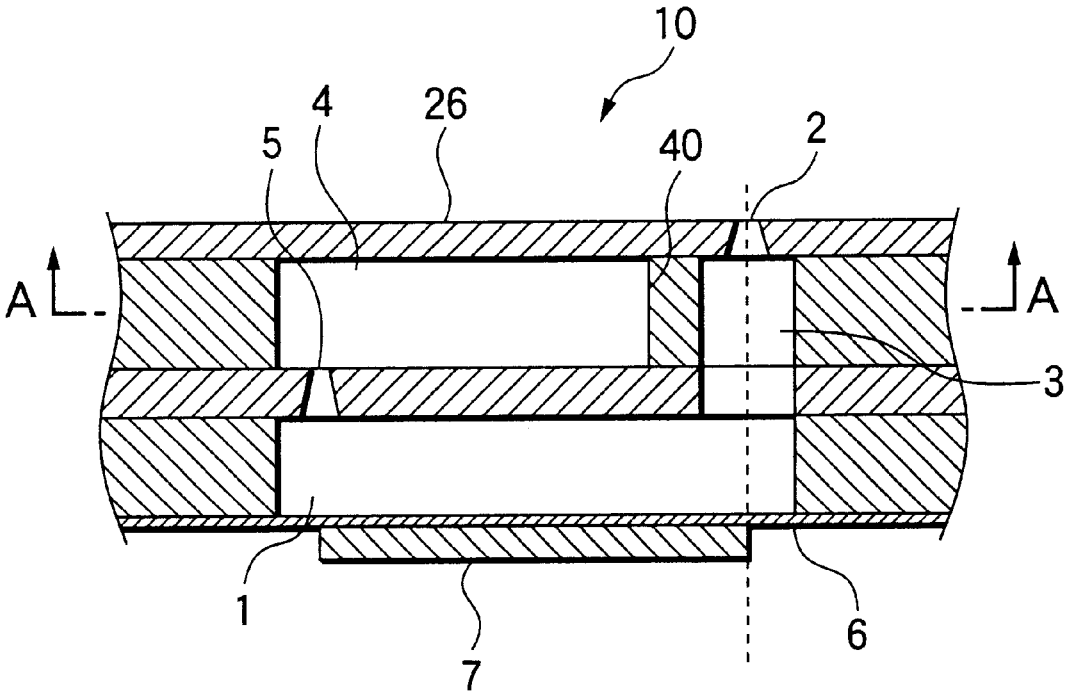
FIG. 1 is a sectional view of an ink jet recording head according to a first embodiment of the invention.

FIG. 1 shows a section of an ejector 10 in an ink jet recording head according to the first embodiment. The ejector 10 is constituted by a pressure generating chamber 1, a nozzle 2, a communication path 3, a common flow path 4, an ink supply path 5, a diaphragm plate 6 and a piezoelectric actuator 7.

The pressure generating chamber 1 communicates with the common flow path 4 through the ink supply path 5 so that ink is charged into the pressure generating chamber 1. The nozzle 2 for ejecting an ink droplet 8 communicates with the pressure generating chamber 1. In addition, the bottom surface of the pressure generating chamber 1 is formed out of the diaphragm plate 6, and the piezoelectric actuator (piezoelectric vibrator) 7 for generating pressure is attached to the diaphragm plate 6. When a driving voltage is applied to the piezoelectric actuator 7, the piezoelectric actuator 7 is bent to expand or compress the pressure generating chamber 1 through the diaphragm plate 6. When there appears a change of volume in the pressure generating chamber 1, a pressure wave is generated in the pressure generating chamber 1. The ink suffers force by the effect of the pressure wave so as to be discharged to the outside from the nozzle 2. Thus, the ink droplet 8 is formed.

Figure 2:
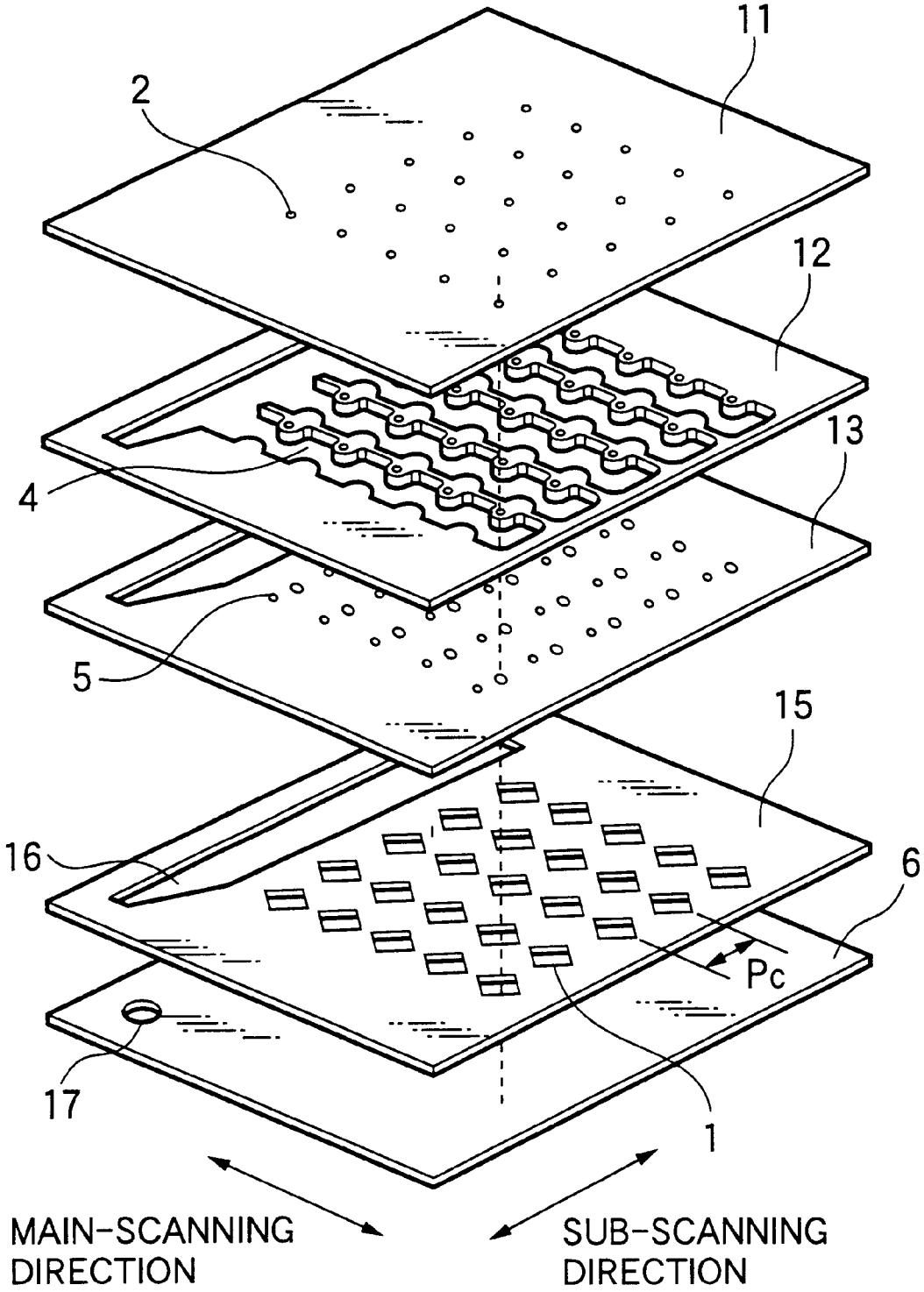
FIG. 2 is a perspective view showing the configuration of plates in the ink jet recording head according to the first embodiment.

FIG. 2 shows the configuration of an ink jet recording head in which ejectors 10 in FIG. 1 are arrayed two-dimensionally. The ink jet recording head is constituted by a total of five plates, that is, a nozzle plate 11, a common flow path plate 12, a supply path plate 13, a pressure generating chamber plate 15 and the diaphragm plate 6. These are laminated and bonded to one another through a bonding agent so as to form a plurality of ejectors 10 arranged in arrays and a second common flow path 16 to which ink is supplied through an ink supply port 17. In the ink jet recording head according to this embodiment, the common flow paths 4 and the pressure generating chambers 1 are arranged to overlap each other two-dimensionally, and each of the common flow paths 4 has a constricted shape to secure acoustic capacitance. Thus, occurrence of crosstalk is prevented.

As shown in FIG. 2, the common flow paths 4 are disposed substantially in parallel with the main-scanning direction of the head, so as to communicate with the second common flow path 16 disposed substantially in parallel with the sub-scanning direction. The second common flow path 16 communicates with an ink tank (not shown) through the ink supply portion 17 so as to play a role of supplying ink to the respective common flow paths 4. The pressure generating chambers 1 communicate with the common flow paths 4. In this embodiment, 26 common flow paths 4 communicate with the second common flow path 16, and 10 ejectors 10 are provided for each of the common flow paths 4. Thus, the ink jet recording head has 260 nozzles.

Figure 3A:
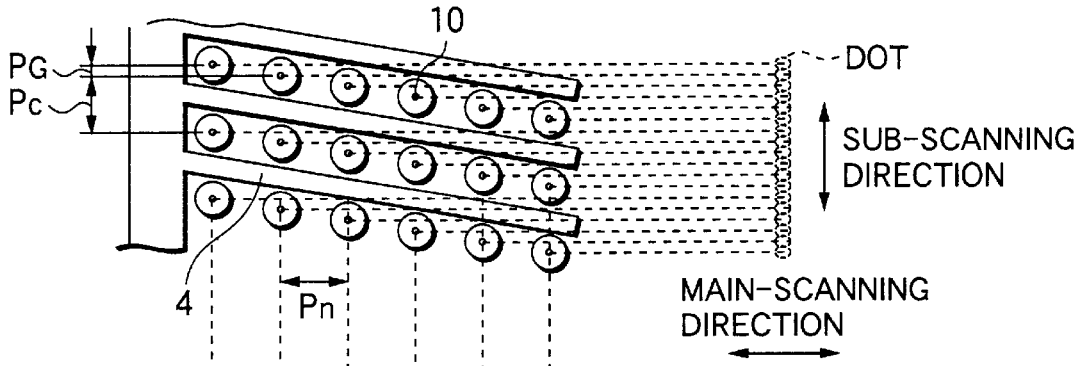
FIG. 3 is schematic views for explaining the arrangement of ejectors in a matrix-array head.
Figure 3B:
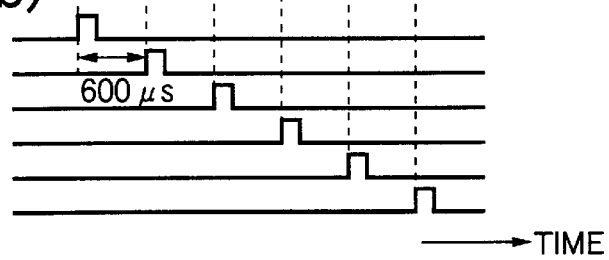

FIG. 3 schematically show a method for arraying the ejectors 10 according to this embodiment. As shown in FIG. 3A, the ejectors 10 communicating with one and the same common flow path 4 are disposed to be shifted from each other by $P_G$ (=$P_c$/n; n designates the number of ejectors 10 connected to the same common flow path 4) in the sub-scanning direction. In the course of the head scanning in the main-scanning direction, ink droplets 8 are ejected from the ejectors 10 in respective columns while their ejecting timings are shifted from each other. Thus, the dot columns are formed in the pitch $P_G$. FIG. 3B shows the ejecting timings of the respective columns of the ejectors 10 according to this embodiment. In this embodiment, the distance $P_n$ between adjacent columns of the columns is set at 600 μm, and the head scanning speed is set at 1 m/s. Accordingly, when ejection is carried out while the ejecting timings of the columns are shifted from each other by 600 μs, dots can be landed in the same position in the main-scanning direction as shown in FIG. 3B. In such a manner, it is one of the great features of the matrix-array head that dot columns in the small pitch $P_G$ can be formed in one head scanning.

In this embodiment, the nozzles 2 each having an opening diameter of 25 μm are formed by excimer laser processing using a polyimide film (Ed=2.0 GPa, νd=0.4) 25 μm thick as the nozzle plate 11. As will be described later, this nozzle plate also has a function as an air damper 26 for the common flow paths. The ink supply paths 5 each having an opening diameter of 26 μm are formed by press working using a stainless steel plate 75 μm thick as the supply path plate 13. A flow path pattern is formed by wet etching using stainless steel plates each 120 μm thick as the common flow path plate 12 and the pressure generating chamber plate 15.

The pressure generating chamber 1 is formed into a quadrangle that is 400 μm square and has an aspect ratio (horizontal to vertical ratio) of 1. An R-shape is added to each corner portion of the pressure generating chamber 1 so as to prevent stagnation in the flow of ink. The common flow path 4 is disposed to overlap the pressure generating chamber 1 two-dimensionally as shown in FIG. 1. Incidentally, overlapping two-dimensionally means overlapping in view of the scanning surface side of the head. Overlapping two-dimensionally will be referred to as "overlapping" simply. When the common flow paths 4 and the pressure generating chambers 1 are disposed to overlap each other in such a manner, the common flow paths 4 and the pressure generating chambers 1 can be disposed efficiently in a small area in comparison with the case where the common flow paths 4 and the pressure generating chambers 1 are disposed in one and the same plane. Accordingly, there is an advantage to miniaturization of the head (high density array of the ejectors 10). A stainless steel plate 10 μm thick is used as the diaphragm plate 6, and piezoelectric ceramics formed into a single plate 30 μm thick is used as the piezoelectric actuator 7.

Figure 4:
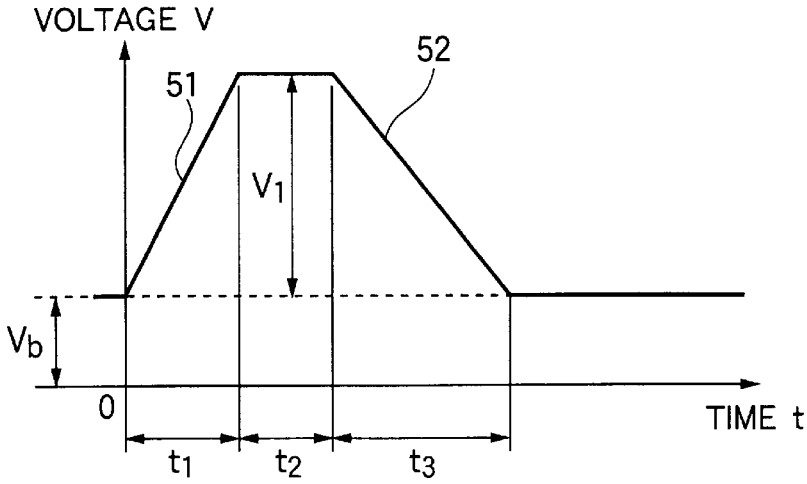
FIG. 4 is a graph showing a driving voltage waveform used in an ink droplet ejecting test.

FIG. 4 shows an example of the waveform of a driving voltage applied to the piezoelectric actuator 7. This driving voltage waveform is constituted by a first voltage change (step-up) process 51 for changing the voltage in a direction to compress the pressure generating chamber 1 and a second voltage change (step-down) process 52 for returning the applied voltage to the initial bias voltage ($V_b$). In the ink jet recording head according to this embodiment, ink droplets each having a droplet volume of 20 pl can be ejected when $V_1$ is set at 30 V. In addition, the refill time ($t_r$) when a single nozzle is driven is 35 $\mu$s.

Figure 5:
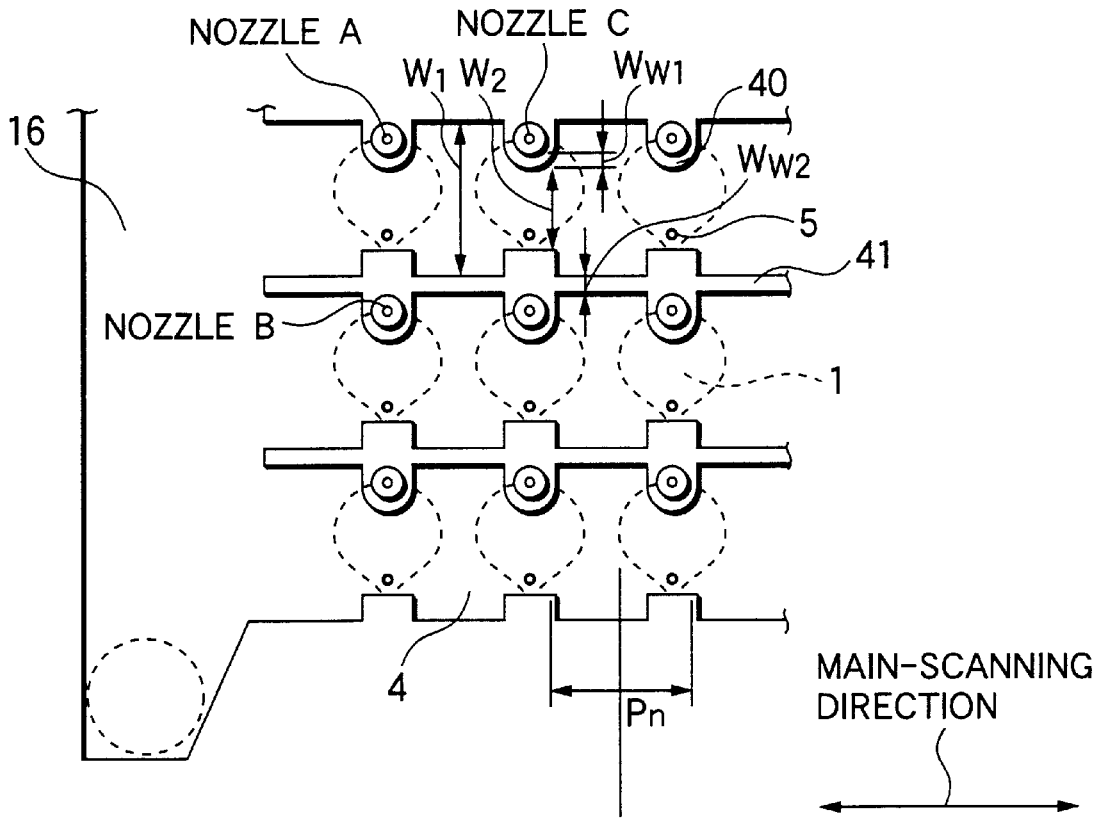
FIG. 5 is a schematic view showing the planar shape of the ink jet recording head.

FIG. 5 schematically shows the arrangement of the ejectors 10. Incidentally, the nozzle positional displacement of the pitch $P_G$ shown in FIG. 3 is omitted in FIG. 5. FIG. 5 is a view taken on arrow A—A in FIG. 1. The width of the common flow path 4 has a constricted shape taking a minimum ($W_2$) between the nozzles A and B opposed to each other through the common flow path 4 and taking a maximum ($W_1$) between the nozzles A and C adjacent to each other along the common flow path 4. Since the common flow path 4 is formed into such a constricted shape, a large width ($W_1$) can be secured partially in the common flow path 4 so that large acoustic capacitance can be obtained. That is, acoustic capacitance required for the common flow path can be secured at a small nozzle pitch $P_c$ in comparison with a related-art head having a common flow path formed into a straight line.

In the ink jet recording head according to this embodiment, the maximum width ($W_1$) of the common flow path 4 is set at 500 $\mu$m, the diameter ($d_T$) of the communication path 3 is set at 150 $\mu$m, the width $W_{W1}$ of the partition wall 40 between the communication path 3 and the common flow path 4 is set at 100 $\mu$m, and the width $W_{W2}$ of the partition wall 41 between the common flow paths 4 is set at 100 $\mu$m. Thus, the nozzle pitch $P_c$ between the nozzles 2 adjacent to each other through the common flow path 4 is 600 $\mu$m ($=W_1+W_{W2}$), and the minimum width ($W_2$) of the common flow path 4 is 250 $\mu$m ($=P_c-d_T-2W_{W1}$). The nozzle pitch $P_n$ between the nozzles 2 adjacent to each other along the common flow path 4 is set at 600 $\mu$m.

On the upper surface of the common flow path 4, the nozzle plate 11 having low rigidity is formed. This portion has a function as the air damper 26. In this ink jet recording head, the acoustic capacitance $c_p$ ($\approx c_d$) of the common flow path 4 (air damper 26) per ejector 10 is about $8.4\times10^{-18}$ $m^5/N$ from the expressions (1) and (2).

Here, description will be made on the acoustic capacitance required for the common flow path 4 on the basis of the knowledge made clear by the inventor. The inventor carries out equivalent circuit analysis upon the ink jet recording head according to this embodiment, using the circuit model shown in FIG. 6, and carries out a practical ink droplet ejecting test. As a result, it is found that the rate of occurrence of acoustic crosstalk through the common flow path 4 depends on the ratio of the acoustic capacitance $c_p$ of the common flow path 4 to the acoustic capacitance $c_c$ of the pressure generating chamber 1, and the occurrence of crosstalk can be prevented if the following condition is satisfied:

$$c_p>20c_c \tag{5}$$

Figure 6:
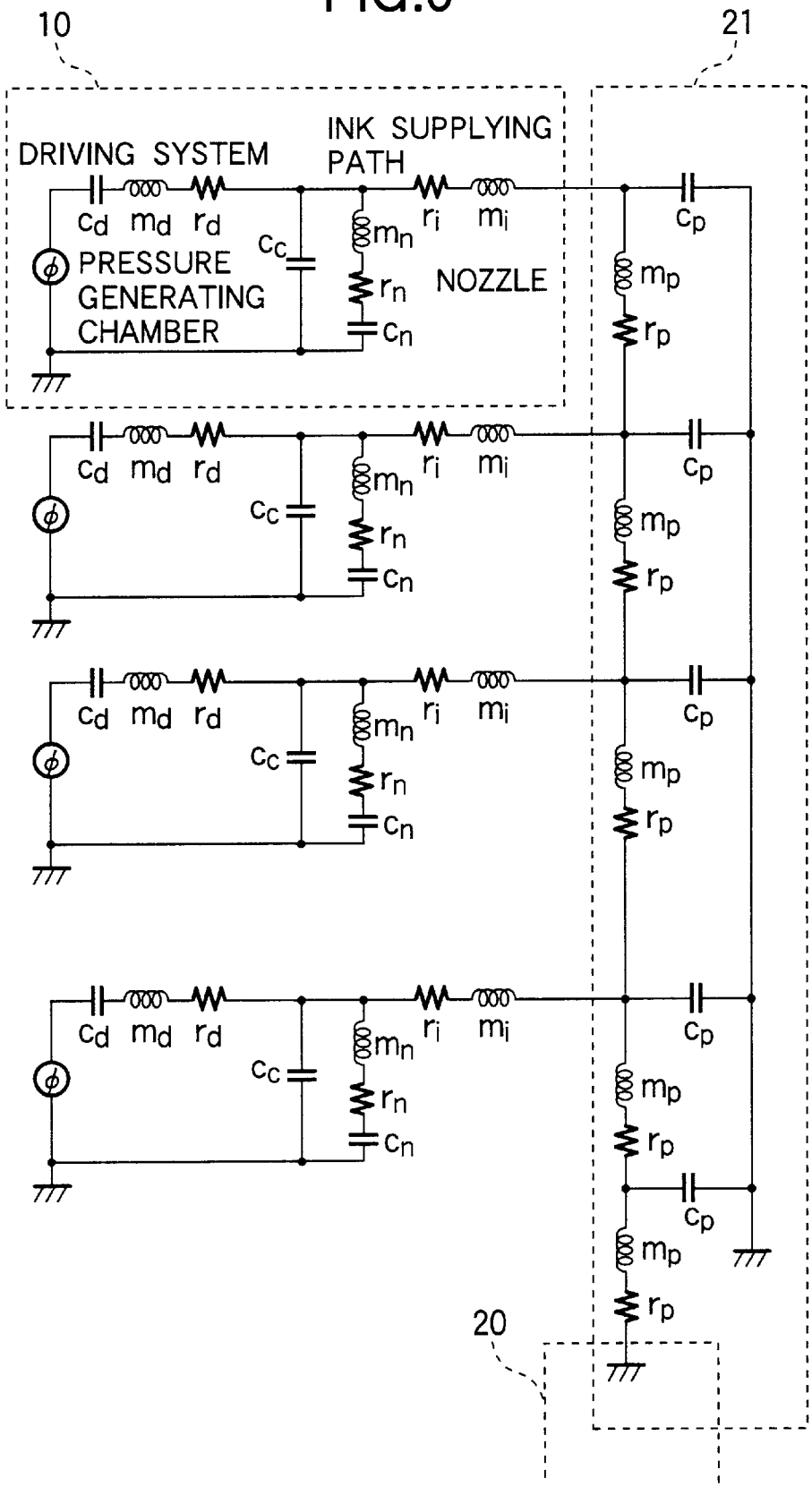
FIG. 6 is a circuit diagram showing an equivalent electric circuit used for analyzing acoustic crosstalk.

Incidentally, the equivalent circuit in FIG. 6 is a circuit model in which one common flow path 4 has been cut out.

The acoustic capacitance $c_c$ of the pressure generating chamber 1 is expressed by:

$$c_c=V_c/(\kappa\cdot K_2) \tag{6}$$

where $V_c$ [$m^3$] designates the pressure chamber volume, $\kappa$ [Pa] designates the elastic coefficient of the ink, and $K_2$ designates the correction coefficient depending on the rigidity of the pressure generating chamber and so on. In addition, the acoustic capacitance $c_p$ of the common flow path 4 is obtained by the expressions (1) and (2). Incidentally, the acoustic capacitance $c_p$ is an acoustic capacitance per ejector. For example, when the total acoustic capacitance of the common flow path 4 is $1\times10^{-17}$ $m^5/N$ and 10 ejectors 10 are connected uniformly in the common flow path 4, $c_p$ is $0.1\times10^{-17}$ $m^5/N$. When the ejectors 10 are not disposed uniformly, the acoustic capacitance of the common flow path 4 is distributed to the respective ejectors 10 in accordance with their arrangement condition. Since the ejectors 10 are disposed uniformly at a pitch ($P_n$) of 600 $\mu$m in this embodiment, the acoustic capacitance per ejector can be obtained by calculation on the assumption that the length of the air damper 26 is set as $l_d$=600 $\mu$m in the expression (2).

Figure 7:
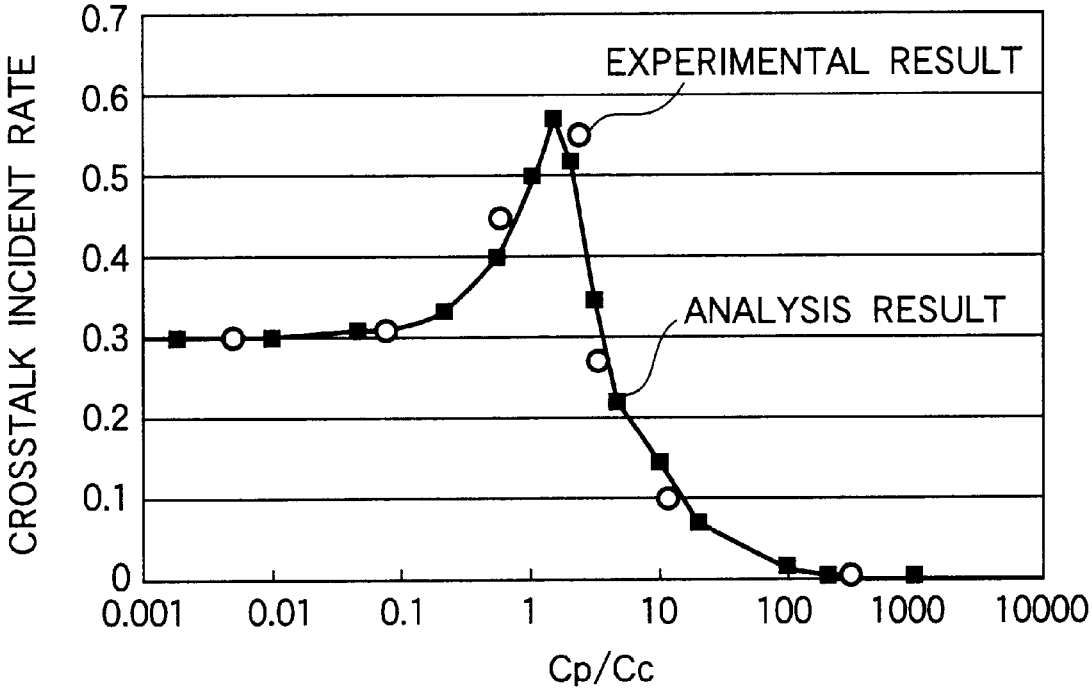
FIG. 7 is a graph showing the relationship between the acoustic capacitance of a common flow path and the rate of occurrence of acoustic crosstalk.

FIG. 7 shows the result of the change of the crosstalk incident rate examined while changing the ratio $c_p/c_c$. The crosstalk incident rate is evaluated as $(v_2-v_1)/v_1$ on the basis of the droplet speed $v_1$ at the time of independent ejection from a single ejector 10 and the droplet speed $v_2$ at the time of concurrent ejection from all the ejectors 10. From the graph of FIG. 7, it is proved that the crosstalk incident rate decreases with the increase of $c_p/c_c$, and the crosstalk incident rate can be suppressed to be 10% or lower if the condition $c_p>20c_c$ is satisfied. In addition, the crosstalk incident rate becomes very high in the range of $0.1<c_p/c_c<10$. It can be considered that this is because the oscillation frequency of the pressure wave generated in the common flow path 4 due to the pressure wave propagated from the pressure generating chamber 1 becomes close to the oscillation frequency of the pressure wave in the pressure generating chamber 1 in the condition of $0.1<c_p/c_c<10$ so that a kind of resonance phenomenon occurs.

Practically, a plurality of ink jet recording heads according to this embodiment, which are different in $c_p/c_c$ with the air damper 26 being changed in width and material, are manufactured byway of trial. When the crosstalk incident rate is examined on the ink jet recording heads, a result very consistent with the equivalent circuit analysis result is obtained as shown in FIG. 7. Incidentally, strictly, the inertance $m_p$ or the acoustic resistance $r_p$ of the common flow path 4 also has an influence on the crosstalk incident rate. In an ordinary ink jet recording head, however, the influence is very small so that the crosstalk incident rate can be regarded as being subject to $c_p/c_c$ as described above.

Figure 8:
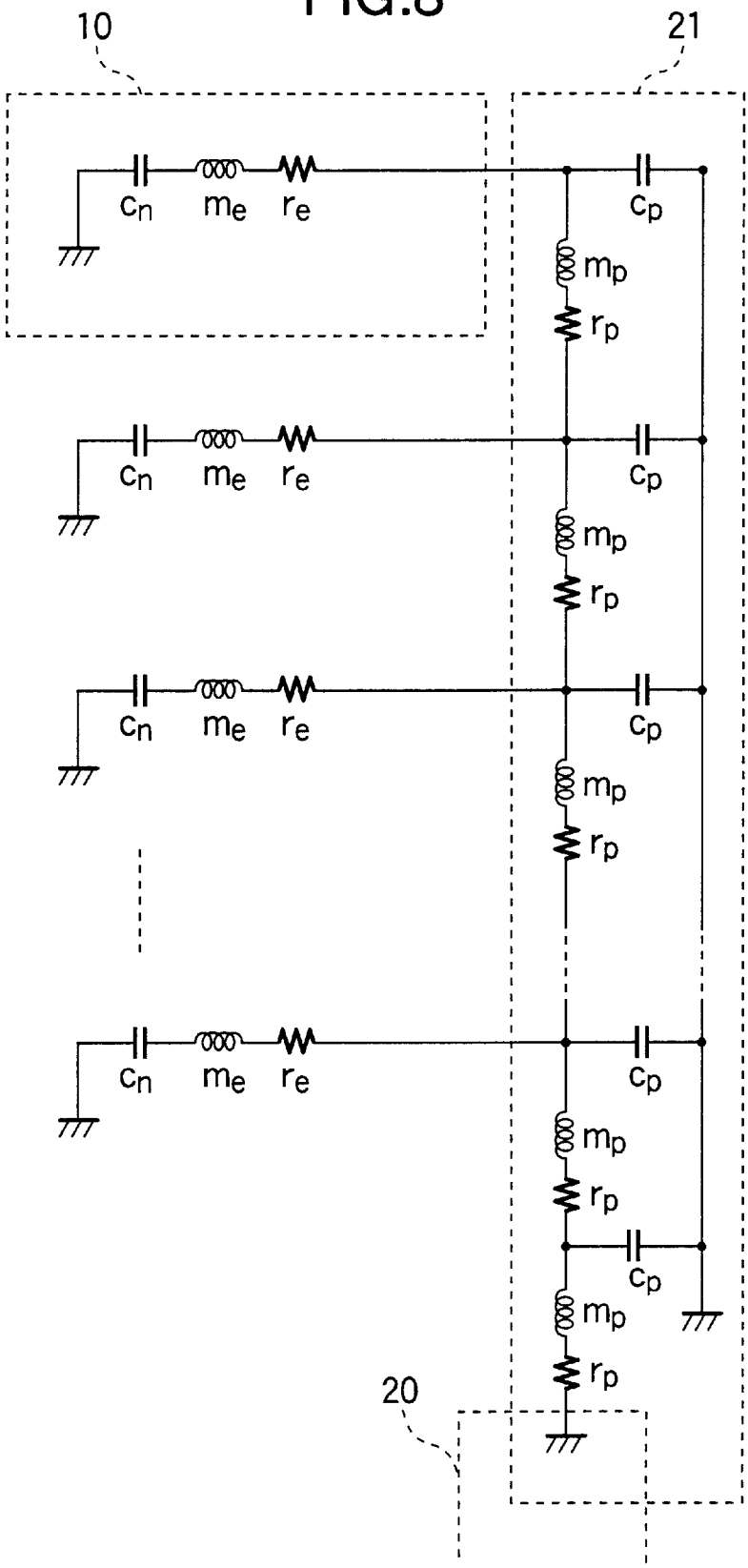
FIG. 8 is a diagram showing an equivalent electric circuit used for analyzing refill time.

In addition, the inventor carries out equivalent circuit analysis using a circuit model shown in FIG. 8, and makes practical testing of ejection of ink droplets. As a result, it is found that the refill time $t_r$ at the time of concurrent ejection from a plurality of ejectors 10 depends on a ratio of the acoustic capacitance $c_p$ of the common flow path 4 to the acoustic capacitance $c_n$ of the nozzle, and the increase of the refill time can be suppressed when the following condition is satisfied:

$$c_p>10c_n \tag{7}$$

Incidentally, the equivalent circuit in FIG. 8 is a circuit model in which one common flow path is cut out and which is changed into a form suitable for analyzing the refill phenomenon. $m_e$ designates the total inertance of the ejectors ($=m_1+m_2+m_3$), and $r_e$ designates the total acoustic resistance of the ejectors ($=r_1+r_2+r_3$).

The acoustic capacitance $c_n$ of the nozzle is expressed by:

$$c_n = \frac{\pi d_n^4}{64\sigma}\sqrt{1+\frac{16y^2}{d_n^2}} \tag{8}$$

where $d_n$ [m] designates the nozzle opening diameter, σ [N/m] designates the ink surface tension, and y [m] designates the meniscus retraction quantity. Thus, as in the expression, the acoustic capacitance $c_n$ of the nozzle depends on the meniscus retraction quantity y. Here, on the assumption of $y \approx d_n/4$ as a representative value, $c_n$ is defined as the following expression.

$$c_n = \frac{\pi d_n^4}{48\sigma} \tag{9}$$

Figure 9:
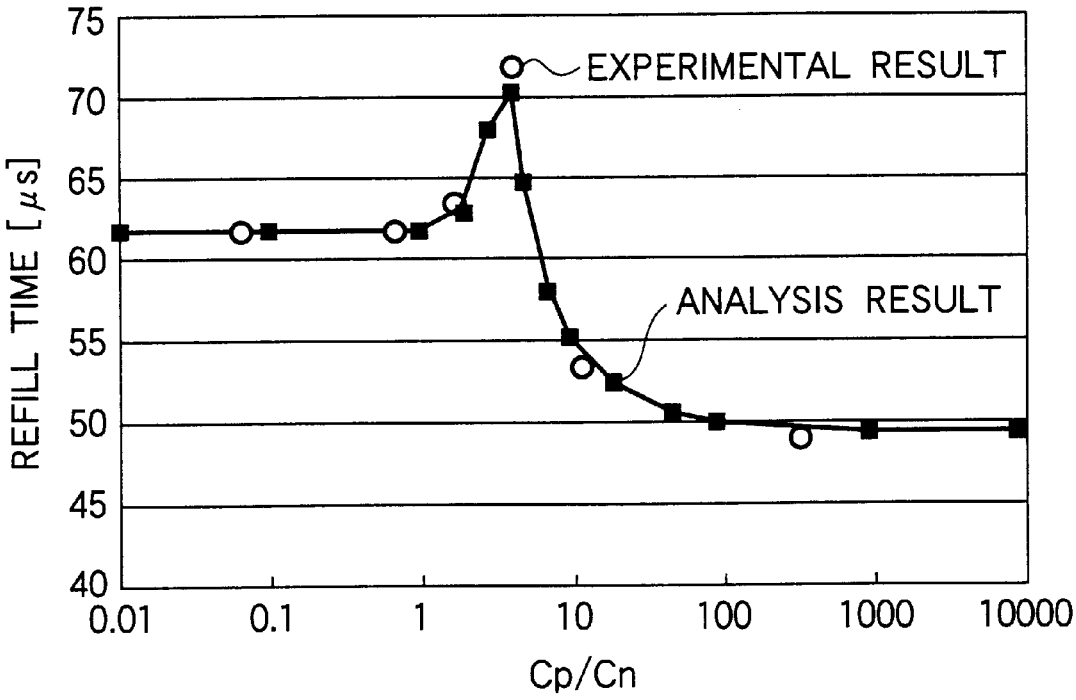
FIG. 9 is a graph showing the relationship between the acoustic capacitance of the common flow path and the refill time.

FIG. 9 shows the result of examination of the relationship between $c_p/c_c$ and the refill time $t_r$. Incidentally, $c_n=8.5\times10^{-19}$ $m^5/N$. From this result, it is proved that the refill time $t_r$ is reduced when $c_p/c_c$ increases, and the refill time can be prevented from increasing and difference in refill time between ejectors can be eliminated when the condition of $c_p>10c_n$ is satisfied. In addition, it is proved that the increase of the refill time is extraordinarily large in a range of $4<c_p/c_c<10$. It can be considered that this is because there occurs interference between the pressure wave in the pressure generating chamber and the pressure wave in the common flow path in the same manner as in the case of the crosstalk.

The result obtained by examining the relationship of $c_p/c_c$ by practical ejection tests is very consistent with the equivalent circuit analysis result as shown in FIG. 9. In addition, from the result of a plurality of kinds of ink jet recording heads manufactured by way of trial, it is proved that the inertance $m_p$ and the acoustic resistance $r_p$ of the common flow path also have a small influence on the increase of the refill time $t_r$, and the properties of the common flow path 4 in the ordinary ink jet recording head may be set on the basis of $c_p/c_c$.

As described above, in order to suppress the crosstalk among the ejectors and the increase of the refill time at the time of concurrent ejection, it is necessary to satisfy the conditions of the expressions (5) and (7). In the ink jet recording head according to this embodiment, the acoustic capacitance $c_p$ ($\approx c_d$) of the common flow path 4 is $8.4\times10^{-18}$ $^5/N$, the acoustic capacitance cn of the nozzle is $7.3\times10^{-19}$ $m^5/N$ (dn=25 μm, σ=35 mN/m), and the acoustic capacitance $c_c$ of the pressure generating chamber is $3.9\times10^{-20}$ $m^5/N$. Thus, $c_p$ is about 12 times as large as $c_n$ and about 215 times as large as $c_c$, satisfying both the conditions of the expressions (5) and (7).

The droplet volume, the droplet speed and the refill time $t_r$ are examined in the ink jet recording head according to this embodiment while changing the ejecting frequency and the number of ejectors performing concurrent ejection. As a result, it is confirmed that the droplet volume and the droplet speed stay in a range of ±2%, and the refill time tr stay in a range of ±2 μs, so that increase of crosstalk and refill time can be suppressed well. That is, in the ink jet recording head according to this embodiment, it is confirmed that the acoustic capacitance of the common flow path is secured sufficiently even if the nozzle pitch $P_c$ is small to be 600 μm.

Figure 28A:
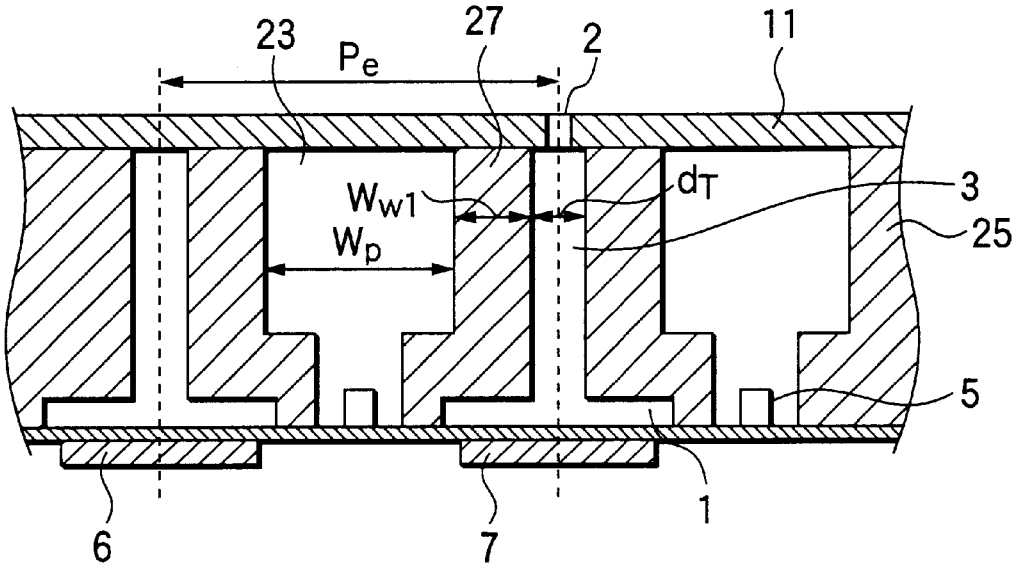
FIG. 28 is views showing the basic structure of a related-art matrix-array head.
Figure 28B:
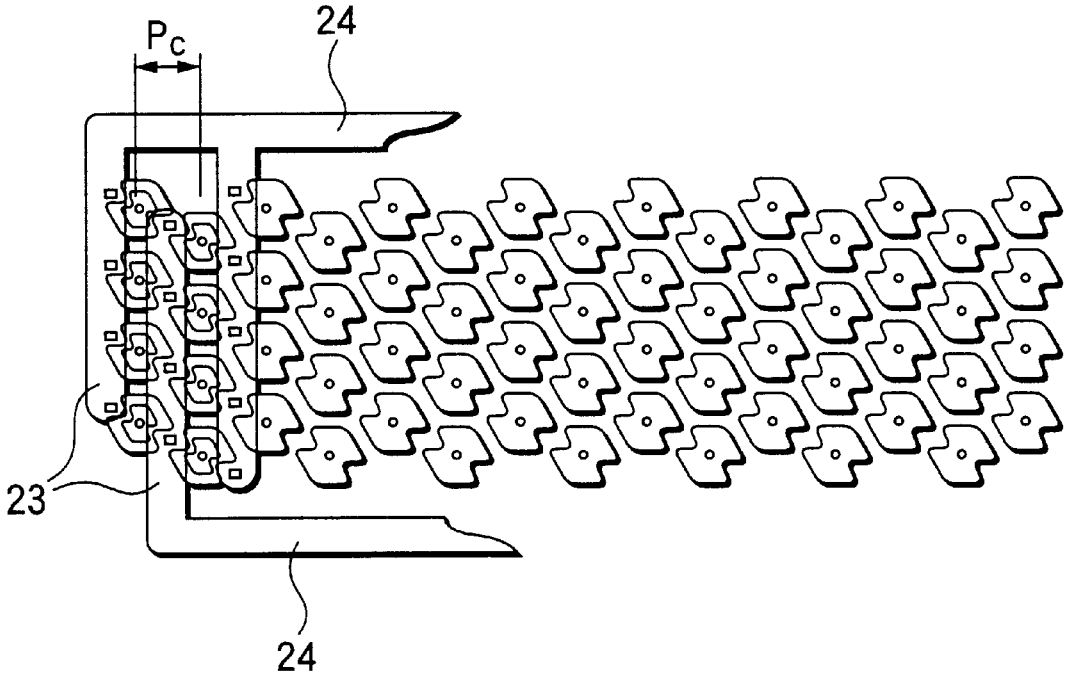
Figure 29:
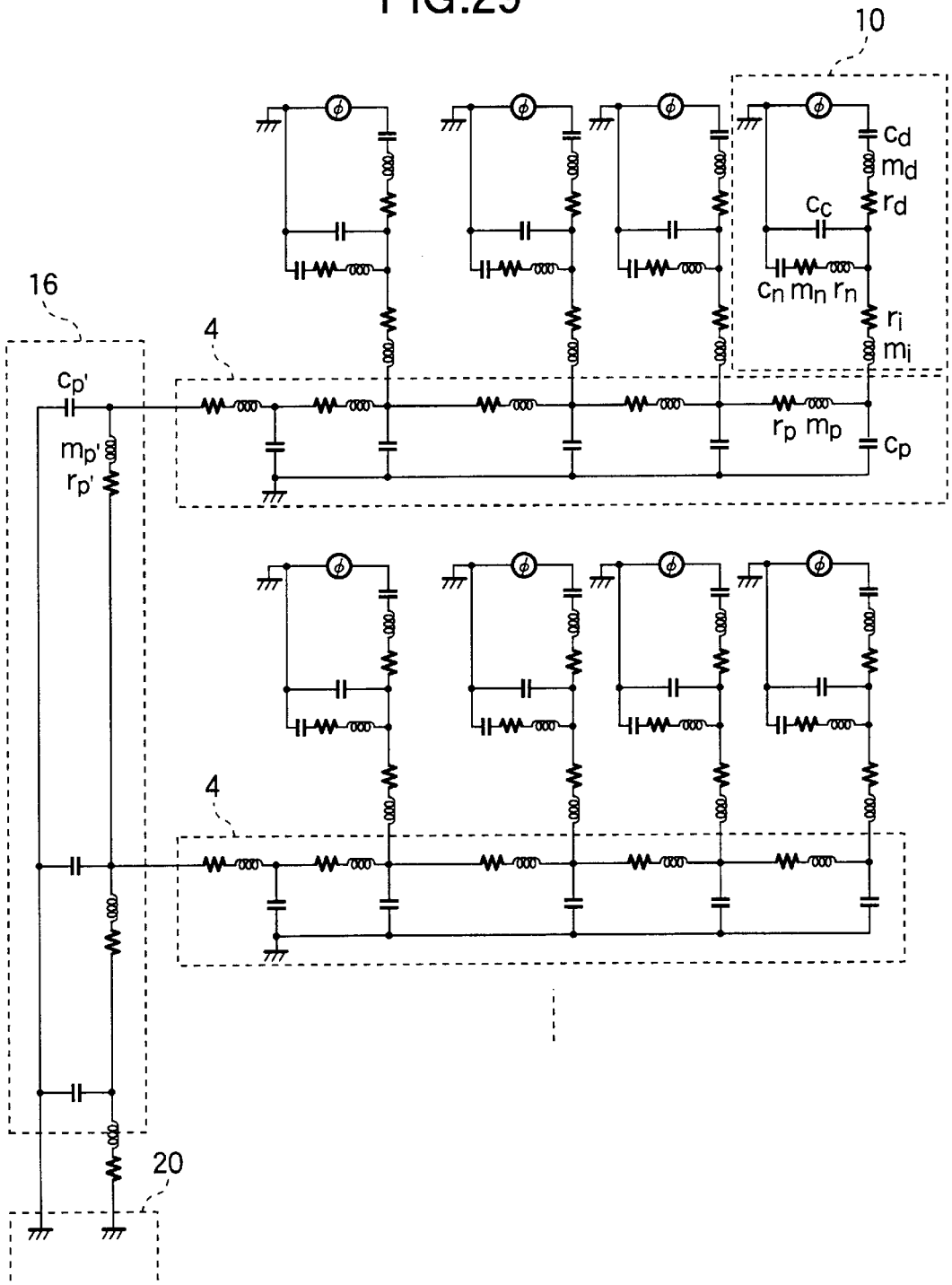
FIG. 29 is a diagram showing an equivalent electric circuit of the matrix-array head.
Figure 30:
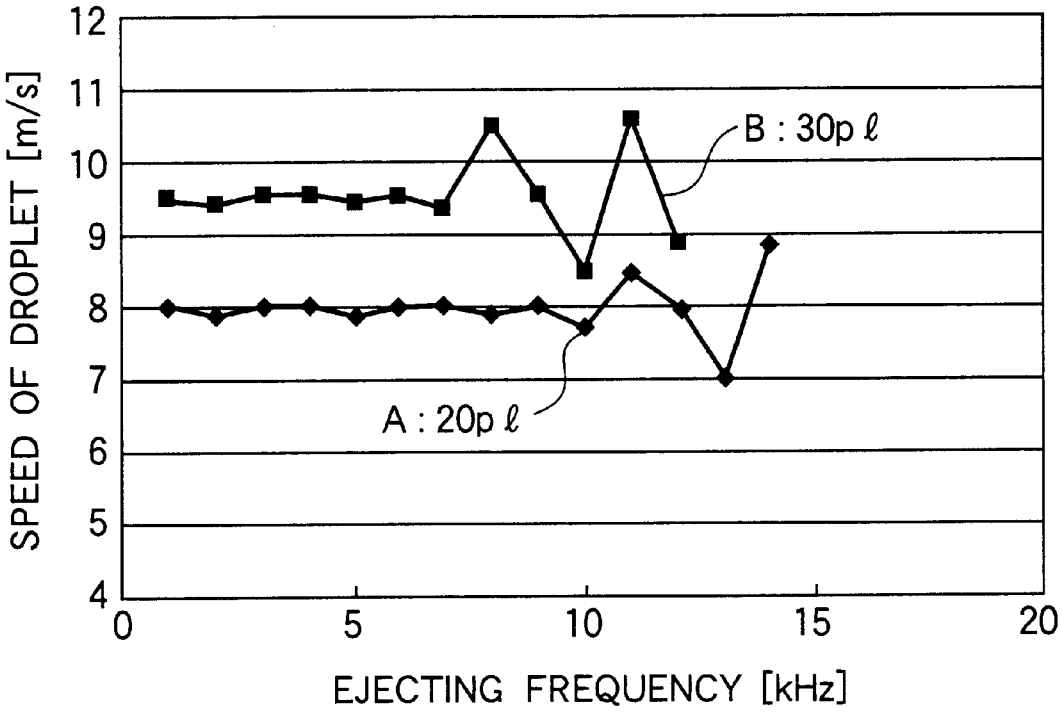
FIG. 30 is a graph showing the ejecting characteristic of the related-art matrix-array head.

A head having a related-art head structure with common flow paths formed into straight lines as shown in FIG. 28 is manufactured as a comparative example by way of trial. The nozzle pitch $P_c$ in the related-art head is set at 600 μm in the same manner as that in this embodiment. Thus, the properties of the related-art head are evaluated. The communication path diameter ($d_T$) and the partition width ($W_{W1}$) between the communication path 3 and the communication flow path 4 are set at 150 μm and 100 μm, respectively in the same manner as those in this embodiment. Accordingly, the width of the common flow path is 250 μm from the expression (3). Thus, the acoustic capacitance of the air damper 26 is small to be $2.3\times10^{-19}$ $m^5/N$, so that the conditions of the expressions (5) and (7) can not be satisfied. As a result, great acoustic crosstalk occurs so that there appears a variation of ±10% or wider in the droplet volumes and the droplet speeds of the ink droplets 8.

In addition, at the time of concurrent ejection from a plurality of nozzles, the refill time $t_r$ increases so that stable ejection is difficult unless the ejecting frequency is reduced to 12 kHz. That is, it is confirmed in the related-art matrix-array head that when the nozzle pitch $P_c$ is set at a small value as in this embodiment, sufficient acoustic capacitance can not be secured in the common flow paths 4 so that there occurs a problem such as crosstalk or increase of refill time $t_r$.

As described above, in the related-art head structure having common flow paths 4 formed into straight lines, the nozzle pitch $P_c$ has to be set to be large enough to secure sufficient acoustic capacitance in the common flow paths 4. In contrast to that the nozzle pitch is 600 μm in this embodiment, ink jet recording as stable as that in this embodiment cannot be achieved in the comparative example having a related-art head structure if the nozzle pitch $P_c$ is set to be smaller than 850 μm. That is, in the ink jet recording head according to this embodiment, the nozzle pitch $P_c$ can be reduced by about 42% in comparison with that in the related-art head. Thus, the nozzle array density can be increased on a large scale.

As described above, in the ink jet recording head according to this embodiment, the nozzle plate 11 is made of a resin material having low rigidity so as to have a function as the air damper 26 for the common flow paths 4. In addition, each of the common flow paths 4 disposed to overlap the pressure generating chambers 1 are formed into a constricted shape. Thus, the nozzle pitch $P_c$ can be set to be small to be 600 μm so that the nozzle density can be set at 2.8 nozzles/$mm^2$. As a result, an ink jet recording head having 260 ejectors 10 can be realized in a small area measuring 8 mm by 16 mm.

Second Embodiment

Figure 10:
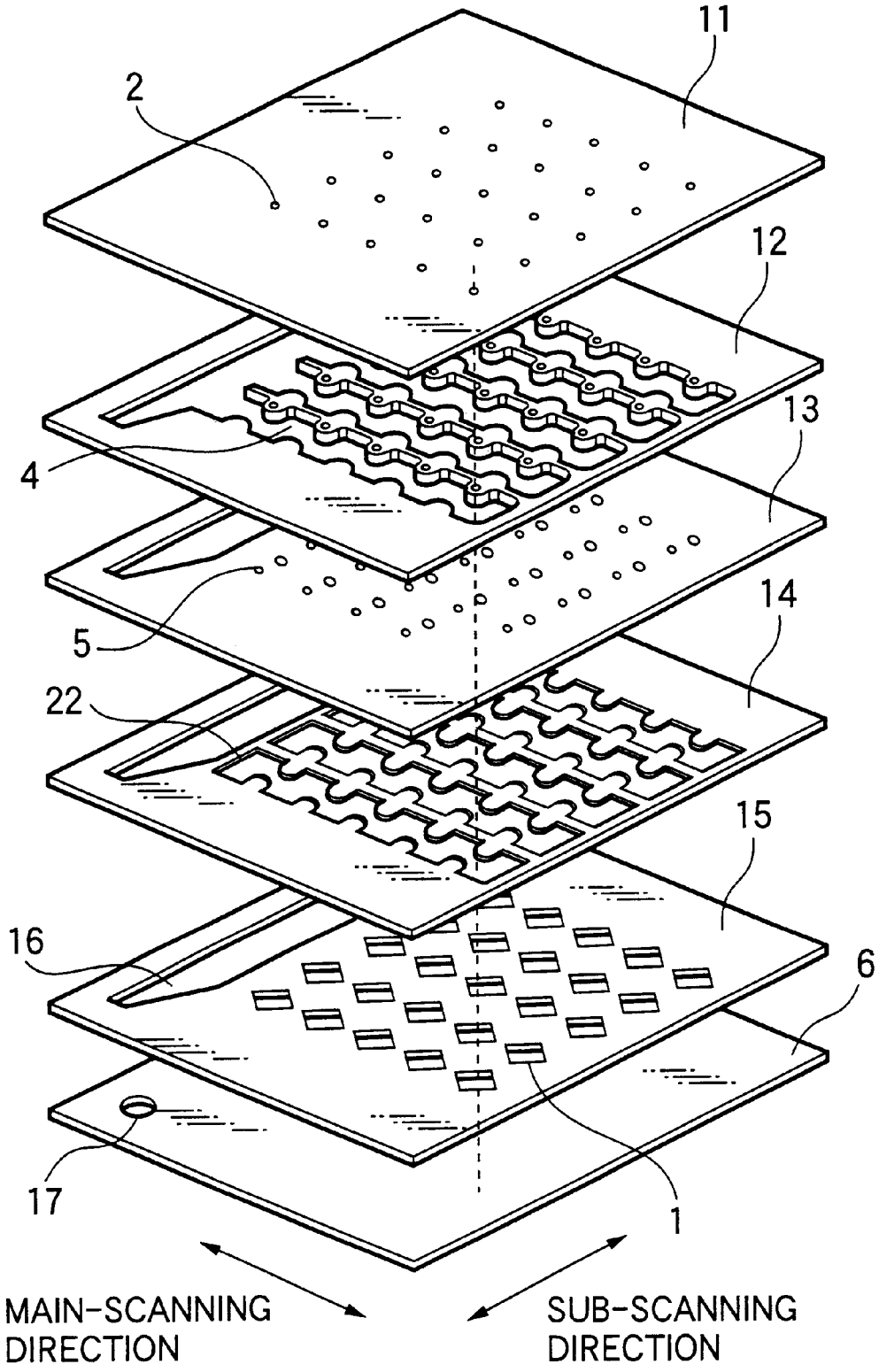
FIG. 10 is a perspective view showing the configuration of plates in an ink jet recording head according to a second embodiment of the invention.
Figure 11A:
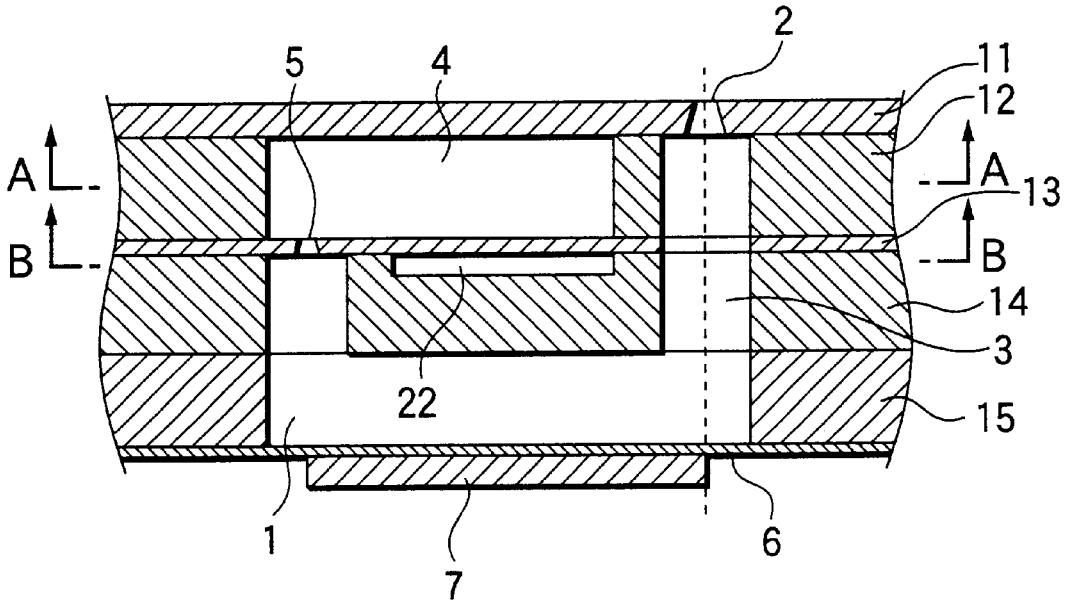
FIG. 11 is sectional views of the ink jet recording head according to the second embodiment.

FIG. 10 shows the configuration of an ink jet recording head according to a second embodiment of the invention. The ink jet recording head according to this embodiment differs from that in the previous embodiment in the following points. That is, the communication path plate 14 is located between the supply path plate 13 and the pressure generating chamber plate 15; a metal plate (stainless steel plate) having high rigidity is used as the nozzle plate 11; and a resin film having low rigidity is used as the supply path plate 13. FIG. 11A shows a section of one ejector 10 in the ink jet recording head of FIG. 10. The ejectors 10 in this embodiment have a different structure from those in the previous embodiment. That is, recess portions 22 are formed in the communication path plate 14 between the pressure generating chambers 1 and the common flow paths 4. In the ink jet recording head according to this embodiment, the thickness of the air damper 26 can be reduced so that the nozzle pitch is further narrowed. In addition, a gentle curve is provided for each constricted portion of the common flow paths 4 so that bubbles are prevented from staying in the constricted portion.

In order to manufacture the ink jet recording head according to this embodiment by way of trail, a stainless steel plate 60 μm thick is used as the nozzle plate 11, and subjected to press working so that nozzles 2 each having an opening diameter of 25 μm are formed in the nozzle plate 11. A polyimide film ($E_d$=2.0 GPa, $\nu_d$=0.4) 12.5 μm thick is used as the supply path plate 13, and subjected to excimer laser processing so that ink supply paths 5 each having an opening diameter of 20 μm are formed in the supply path plate 13. This supply path plate 13 has a function as the air damper 26 for the common flow paths 4, as will be described later. Incidentally, in order to secure a large capacitance in the air damper 26, it is desired that the thickness of the supply path plate 13 is not larger than 30 μm.

Stainless steel plates 120 μm thick are used for the common flow path plate 12, the communication path plate 14 and the pressure generating chamber plate 15, and a flow path pattern is formed in the stainless steel plate by etching. Each of the pressure generating chambers 1 is formed to have a quadrangular plane shape 400 μm square and having an aspect ratio close to 1, and each corner of the pressure generating chamber 1 is formed as an rounded corner in order to improve the bubble discharge property. In the communication path plate 14, the recess portions 22 are formed in portions corresponding to the common flow paths 4 by half etching. The recess portions 22 form cavity portions between the supply path plate 13 and the communication path plate 14 when both the plates are laminated. The portions function as the air damper 26.

Figure 11B:
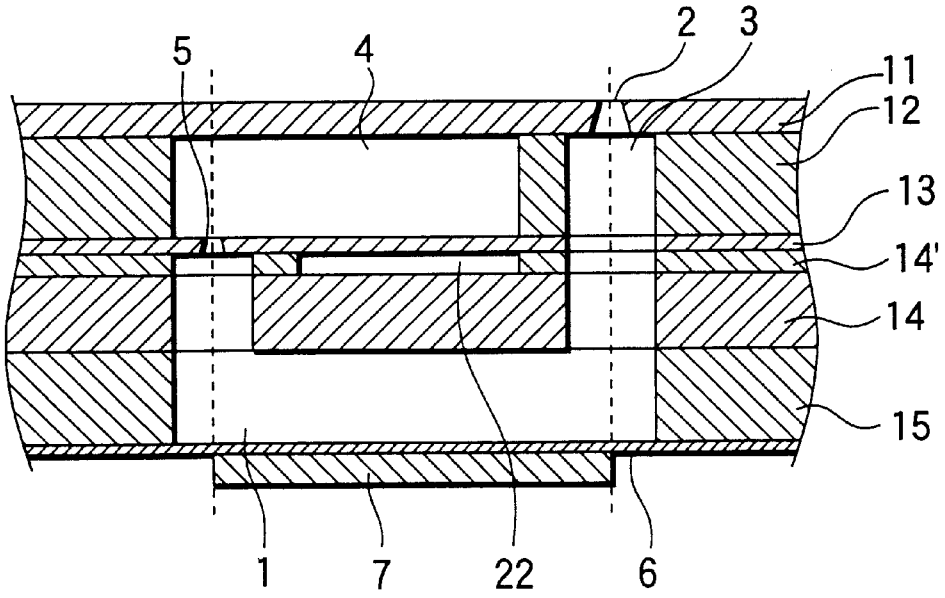

Incidentally, as shown in FIG. 11B, a similar structure can be formed without providing the recess portions 22 in the communication path plate 14. That is, another plate 14' may be laminated between the supply path plate 13 and the communication path plate 14. However, when the recess portions 22 are formed by half etching as in this embodiment, the number of plates constituting the head can be reduced advantageously to reduction in manufacturing cost. In addition, though not shown in FIG. 11, a vent path for making communication with the outside air is provided in each of the recess portions 22. Consequently, the air in the cavities formed by the recess portions 22 always has the same pressure as that of the outside air so that the function of the air damper 26 can be improved. In addition, since there is no closed space, the plates can be laminated and bonded to one another easily when the head is manufactured.

Figure 12A:
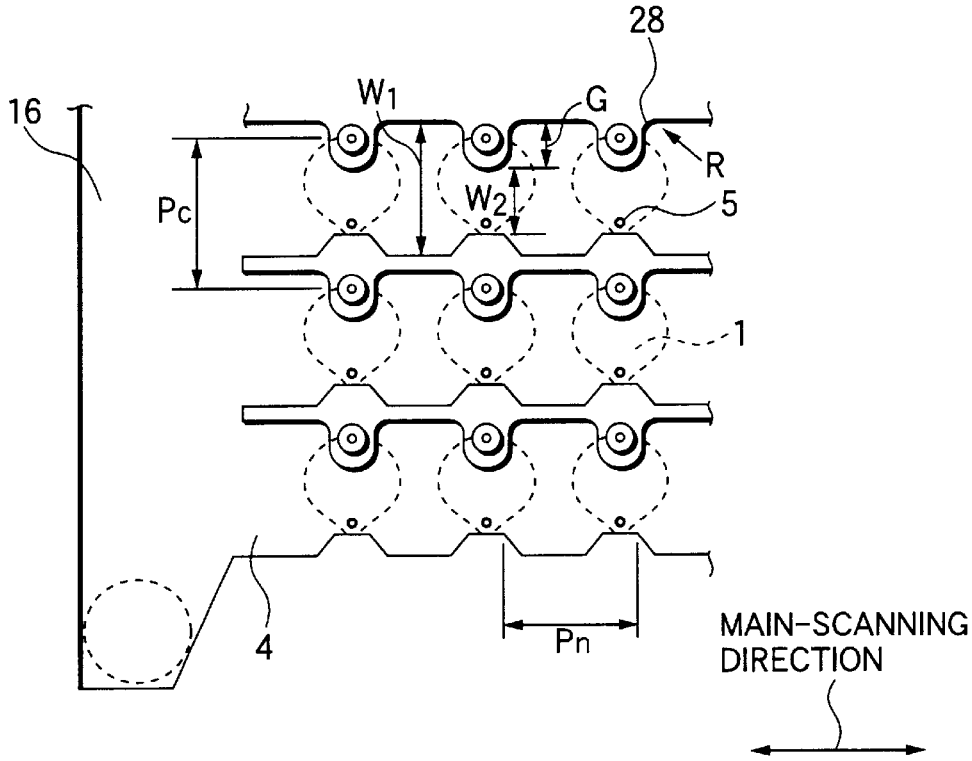
FIG. 12 is views showing the planar shape of the ink jet recording head according to the second embodiment.
Figure 12B:
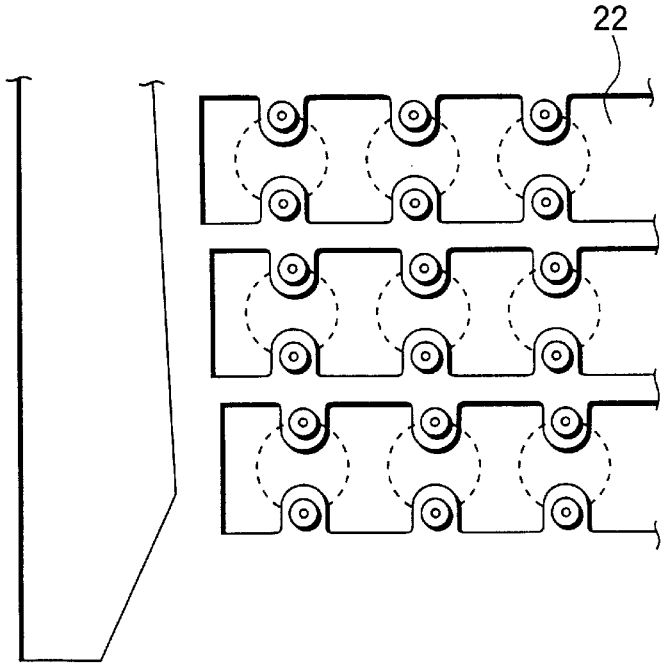

FIG. 12 shows a section of the ejectors of 11. FIG. 12A is a section taken on line A—A in FIG. 11A, and FIG. 12B shows a section taken on line B—B in FIG. 11A. As shown in FIG. 12A, each of the common flow paths 4 has a constricted shape similar to that in the first embodiment. In the same manner, the shape of each of the recess portions 22 formed in the communication path plate 14 also has a constricted shape corresponding to the shape of the common flow path 4 as shown in the sectional view of FIG. 12B taken on the line B—B.

As described above, in the ink jet recording head according to this embodiment, the bottom surface of the common flow path 4 is formed by the supply path plate 13 having low rigidity, and this portion has a function as the air damper 26. Accordingly, the supply path plate 13 can be made so thin that the air damper 26 can be set to be very thin. Thus, even when the nozzle pitch $P_c$ is set to be narrow, sufficient acoustic capacitance can be secured in the common flow path 4 so that the nozzle array density can be further increased.

There is a limit on the reduction of the air damper thickness when the nozzle plate 11 is formed as the air damper as in the first embodiment. This is because the reduction of the air damper thickness results in the reduction of the length of the nozzles 2, and when the length of the nozzles 2 is reduced, there arises such a problem that the direction to eject the ink droplets 8 deteriorates easily or bubbles are involved easily. Therefore, in the head structure according to the first embodiment, the air damper thickness has a lower limit at about 20–50 μm. In addition, since the air damper 26 is exposed to the outside in the head structure according to the first embodiment, the air damper thickness has to be set to be not smaller than a certain value also from the point of view of improvement of reliability of the head such as prevention of the nozzle plate 11 from being damaged, or prevention of bubbles from being involved into the nozzles 2 when the nozzles 2 are wiped.

In the head structure according to this embodiment, the nozzles 2 are independent of the air damper 26, and the air damper is not exposed to the outside. Thus, the air damper thickness can be set to be very small. In this embodiment, the supply path plate thickness which is also the air damper thickness is set at 12.5 μm. As is understood from the expression (2), the acoustic capacitance of the air damper 26 is inversely proportional to the third power of its thickness. Accordingly, when the air damper thickness is reduced, the width of the air damper 26 can be reduced for obtaining the same acoustic capacitance. In this embodiment, the maximum width W1 of the common flow path 4 and the nozzle pitch $P_c$ are set at 400 μm and 500 μm, respectively, which are smaller than those in the first embodiment. In spite. of such setting, a larger acoustic capacitance ($2.2\times10^{-17}$ $m^5/N$) than that in the first embodiment can be secured in the common flow path 4 in this embodiment.

In addition, in the ink jet recording head according to this embodiment, an R-curve portion 28 is provided in each constricted portion of the common flow path 4 so as to form the planar shape of the common flow path 4 out of a smooth curve as shown in FIG. 12. This is to make the ink flow uniform in the common flow path 4 so as to improve the bubble discharge property. When the common flow path 4 is formed into a constricted shape, great unevenness is apt to appear in the flow rate in the common flow path 4. Particularly, in the structure where there is a large step in the shape of the common flow path 4 as in the first embodiment, a stagnation point very small in flow rate is apt to appear near the step portion. Therefore, when ink is introduced into the common flow path 4, bubbles may stay in the stagnation point.

Bubbles staying in the common flow path 4 may have no great influence on the ejecting characteristic unless the bubbles move. However, when the bubbles staying in the common flow path 4 move for some reason such as vibration and flow into the pressure generating chamber 1 through the ink supply path 5, the ink droplet 8 cannot be ejected accurately from the ejector 10. That is, the bubbles staying in the common flow path 4 cause significant damage to the reliability of the ink jet recording head. It is therefore necessary to prevent bubbles from staying in the common flow path 4. Accordingly, in the ink jet recording head according to this embodiment, the R-curve portion 28 is provided in each constricted portion of the common flow path 4 so as to prevent the stagnation point from appearing therein and suppress the survival of bubbles.

The preferable range of the curvature radius (R) in the R-curve portion 28 changes in accordance with the average ink flow rate in the common flow path 4, the material of the wall of the common flow path 4, the material of ink, and so on. However, according to the result of evaluation on a large number of heads manufactured by way of trial by the inventor, it is preferable that the curvature radius is set to satisfy R≧G/4. Here, G designates the magnitude of a difference in the step as shown in FIG. 12. In the ink jet recording head according to this embodiment, G is set at 125 μm, and R is set at 50 μm.

As a result of evaluation of ink filling on the ink jet recording head having the common flow paths 4 provided with the R-curve portions 28, it is confirmed that no bubbles stay in the common flow paths 4. The evaluation of ink filling is performed as follows. That is, ink is sucked from the nozzles for 5 seconds at a suction pressure of 300 mmHg. After that, the condition in the common flow paths 4 is observed through a microscope so that the presence/absence of residual bubbles is confirmed. As a subject of comparison, similar evaluation of ink filling is carried out on the ink jet recording head according to the first embodiment. As a result, bubbles stay in constricted portions (step portions) with the probability of about 60%.

The droplet volume, the droplet speed and the refill time of the ink droplets 8 are examined in the ink jet recording head according to this embodiment while changing the ejecting frequency and the number of ejectors made to perform concurrent ejection. As a result, it is confirmed that the fluctuations of the droplet volume and the droplet speed stay in a range of ±2%, and the fluctuation of the refill time stay in a range of ±1.5 μs, so that crosstalk and refill time increase can be suppressed well.

As described above, in the ink jet recording head according to this embodiment, the supply path plate 13 formed out of a resin film has a function as the air damper for the common flow paths 4. Thus, even if the nozzle pitch $P_c$ is set to be further small to be 500 μm, a sufficient acoustic capacitance can be secured in the common flow paths 4. Thus, ink jet recording can be carried out in good condition. In addition, since the R-curve portion 28 is provided for each constricted portion of the common flow paths 4, the property of discharging bubbles from the common flow paths 4 can be improved on a large scale so that an ink jet recording head having high reliability can be produced. The nozzle array density is 3.3 nozzles/mm2, and can be increased by about 20% in comparison with that in the first embodiment.

Incidentally, although the R-curve portion 28 having a constant curvature radius R is provided for each step portion (constricted portion) of the common flow paths 4 in this embodiment, the R-curve portion 28 does not always have to have a constant curvature radius if the planar shape of each common flow path 4 is formed out of a smooth curve. In addition, the "smooth curve" may be a set of small straight lines.

Third Embodiment

Figure 13:
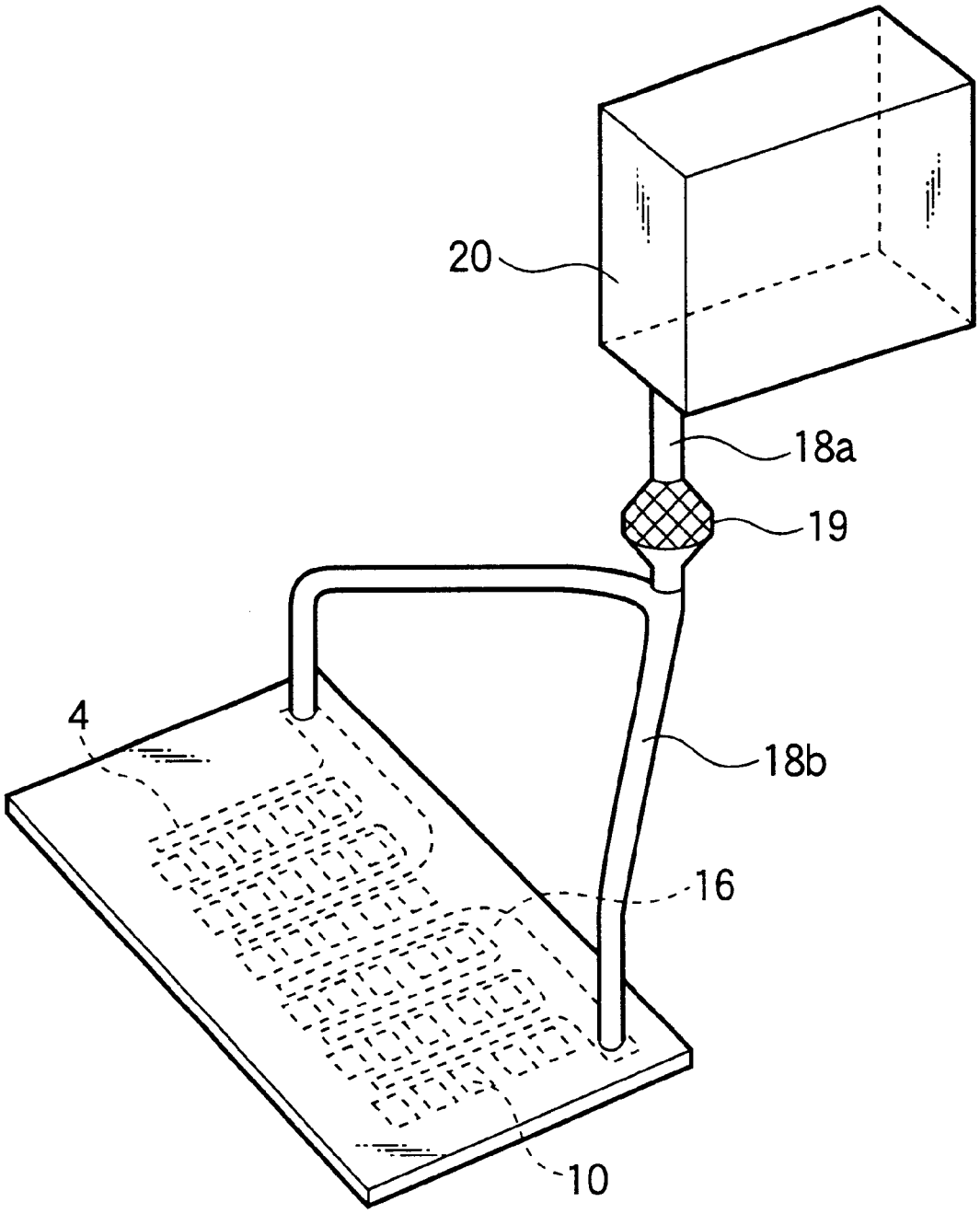
FIG. 13 is a view showing the arrangement of common flow paths in an ink jet recording head according to a third embodiment of the invention.

FIG. 13 shows the basic structure of a third embodiment of the invention. An ink jet recording head according to this embodiment is constituted by a plurality of ejectors 10, common flow paths 4, second common flow paths 16, ink conduits 18*a* and 18*b*, a filter 19 and an ink tank 20. In the ink jet recording head according to this embodiment, the fluid resistance (acoustic resistance) of the ink supply system including the common flow paths 4 and the second common flow paths 16 is set to be not higher than a predetermined value. When the fluid resistance of the ink supply system is set to be not higher than the predetermined value, large ink droplets 8 can be ejected concurrently and continuously from a large number of nozzles 2.

The basic structure of the ink jet recording head according to this embodiment is the same as what is shown in the second embodiment. The ejectors 10 communicate with the common flow paths 4, respectively. The common flow paths 4 communicate with the second common flow paths 16, respectively. The second common flow paths 16 communicate with the ink tank 20 through the ink conduits 18*b*, the filter 19 and the ink conduit 18*a*. Ten ejectors 10 are disposed in each of the common flow paths 4, and a total of 26 common flow paths 4 are connected to the second common flow paths 16. Thus, an ink jet recording head having 260 ejectors is formed.

Figure 14:
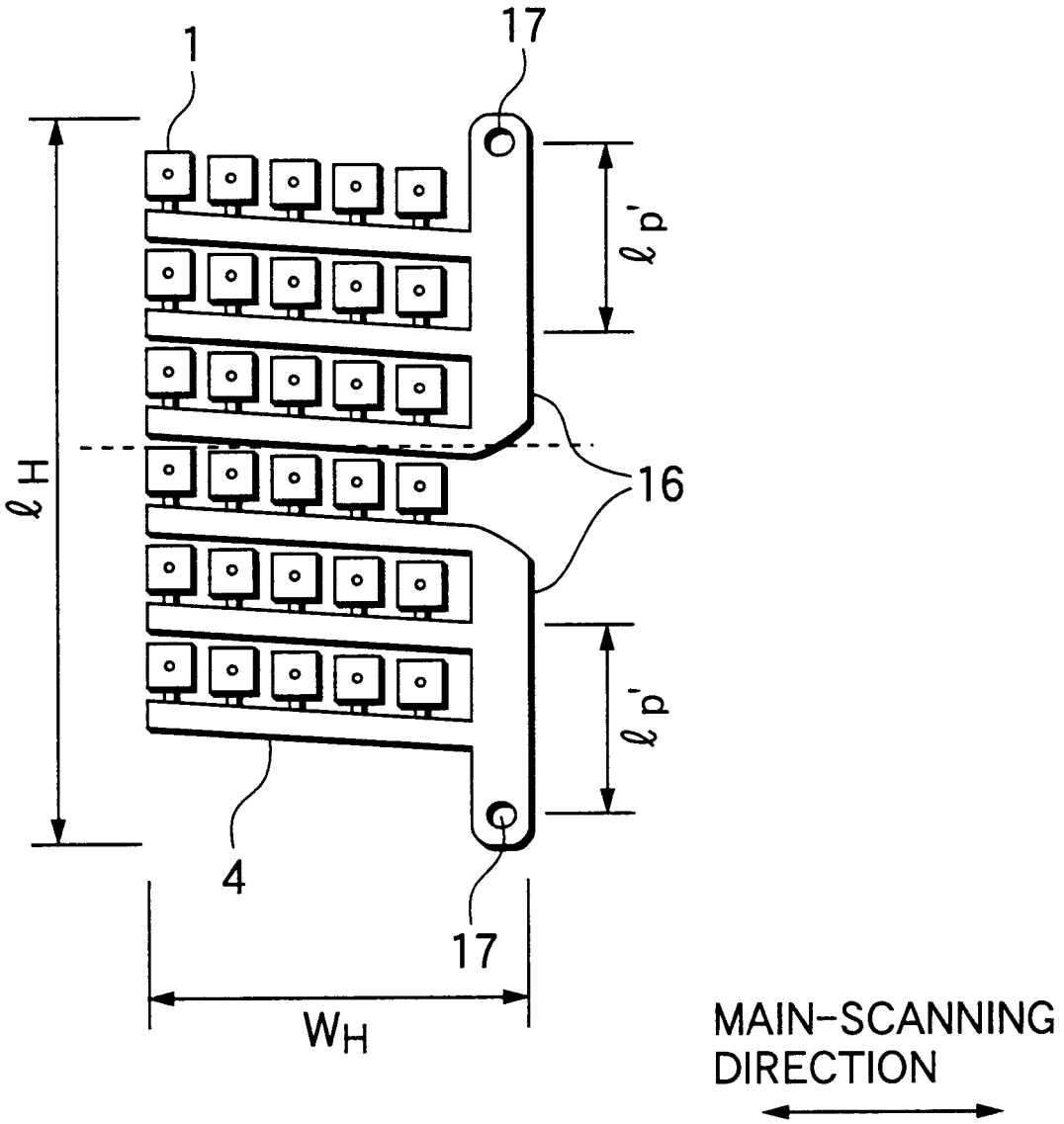
FIG. 14 is a view showing the configuration of an ink supply system according to the third embodiment.

FIG. 14 schematically shows the ink jet recording head according to this embodiment. Each of the common flow paths 4 is set at about 400 μm in width (average width), 120 μm in height and about 6 mm in length. On the other hand, each of the second common flow paths 16 is set at 2.5 mm in width, about 250 μm in height and about 6 mm in length ($l_{p'}$). In the ink jet recording head according to this embodiment, the respective ejectors are disposed as shown in FIG. 14. Thus, when the common flow paths 4 and the second common flow paths 16 are viewed from each ejector, the average length ($l_p$) of the common flow paths 4 is about 3 mm, and the average length ($l_{p'}$) of the second common flow paths 16 is about 3 mm.

Generally, the fluid resistance (acoustic resistance) of a conduit having a rectangular shape in section can be calculated by use of the following expression (where η designates the ink viscosity [Pa·s], S designates the conduit sectional area [$m^2$], and z designates the aspect ratio of the conduit section).

$$\frac{12\eta l}{s^2}\left\{0.33 + 1.02\left(z + \frac{1}{z}\right)\right\} \tag{10}$$

Accordingly, the flow path resistance of the common flow path 4 is $1.9\times10^{11}$ Ns/$m^5$, and the flow path resistance of the second common flow path is $2.9\times10^{9}$ Ns/$m^5$ (η=3 mPa·s). Incidentally, an ink supply port 17 is provided in each of the two divided second common flow paths in the ink jet recording head according to this embodiment. This is to reduce the length ($l_{p'}$) of each second common flow path so as to lower its flow path resistance.

In addition, each of the ink conduit 18*a* and the ink conduits 18*b* is formed into an annular shape, whose inner diameter is set at 2 mm. The ink conduits 18*a* and 18*b* are set at 3 mm and 20 mm in length, respectively. The fluid resistance of a conduit having an annular shape in section can be calculated by the following expression (where d designates the conduit diameter [m], and l designates the conduit length [m]).

$$r = \frac{128\eta l}{\pi d^4} \tag{11}$$

From the expression, the flow path resistances of the ink conduits 18*a* and 18*b* are $2.3\times10^{7}$ Ns/$m^5$ and $1.5\times10^{8}$ Ns/$m^5$, respectively. The filter 19 is a metal mesh having about 10 μm pores. The flow path resistance of the filter 19 is obtained as $1.0\times10^{9}$ Ns/$m^5$ from its measurement result. The ink tank 20 is set to have a large flow path area in section so that its flow path resistance becomes very small. The flow path resistance of the ink tank 20 is $2.0\times10^{8}$ Ns/$m^5$.

Figure 15:
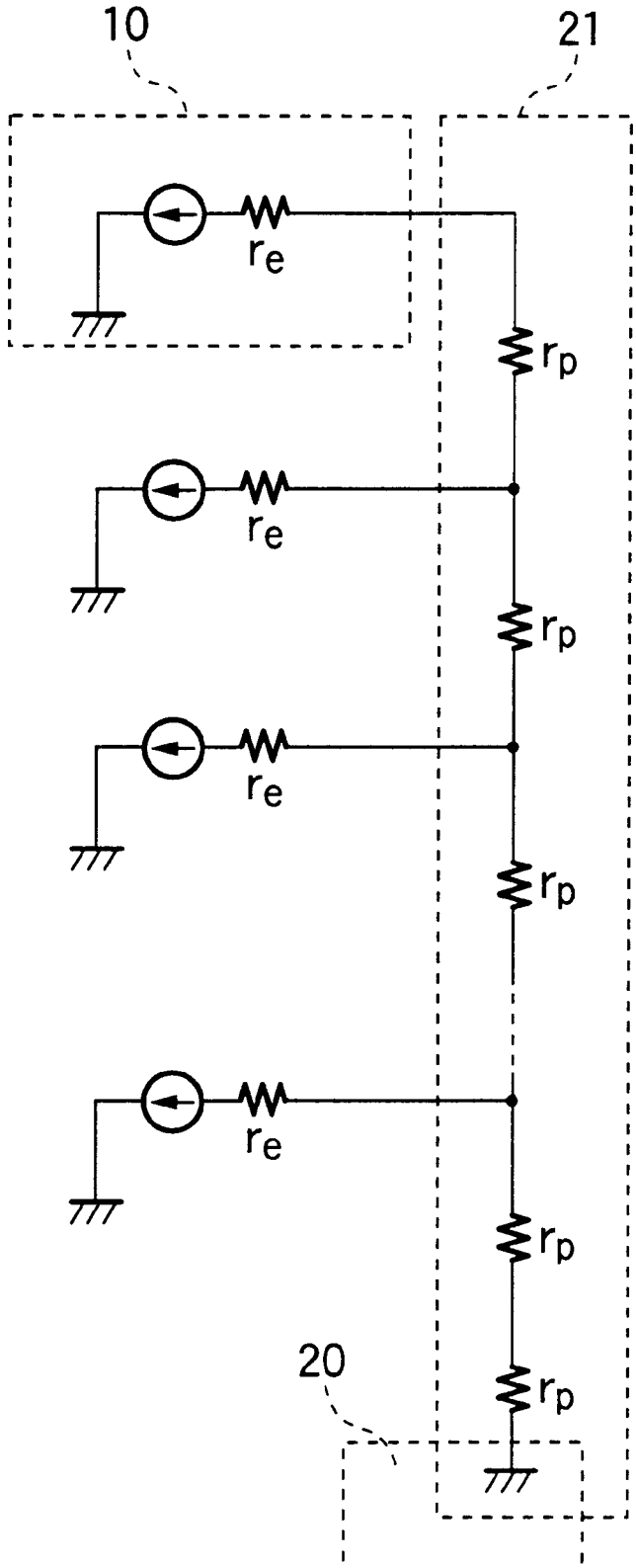
FIG. 15 is a diagram showing an equivalent electric circuit used for analyzing the change of pressure in a flow path at the time of continuous ejection from multiple nozzles.

Here, description will be made on the upper limit value of the fluid resistance of the ink supply system on the basis of the knowledge made clear by the inventor. FIG. 15 shows an equivalent circuit of a plurality of ejectors 10 connected to one and the same common flow path 4. The inventor carries out equivalent circuit analysis using the circuit model shown in FIG. 15, and makes practical ink droplet ejecting tests. As a result, the inventor finds that a pressure drop occurs in the common flow paths 4 when continuous ejection from a large number of ejectors is performed at a high frequency, and this pressure drop causes reduction in the refill speed $t_r$ of each ejector 10. The details will be described below.

Macroscopically, quasi-stationary flows from the ink tank 20 toward the nozzles 2 are generated when the ink droplets 8 are ejected from the nozzles 2 continuously. That is, ink is supplied to the ejectors 10 through the common flow path 4 in quasi-stationary condition. When such quasi-stationary flows are regarded as perfectly stationary flows, the equivalent circuit can be simplified as shown in FIG. 15.

The subject of discussion here is the total fluid resistance of the ink supply system from the ink tank 20 to the common flow path 4. The difference in pressure between the inlet and the outlet of a conduit is expressed by $\Delta P = r \cdot Q$ (Hagen-Poiseulle's law) where r designates the fluid resistance and Q designates the flow rate. When the ink consumption (ink discharge quantity) of the ejectors is great, ink flows into the ink supply system at a high flow rate. On this occasion, when the fluid resistance r of the ink supply system is large, there occurs a large difference in pressure between the ink tank 20 and the common flow path 4. That is, when ink droplets 8 large in droplet volume are ejected concurrently from a large number of nozzles 2 at a high frequency, the pressure in the common flow path 4 drops.

Here, consideration will be made about the refill operation. At the time of refill operation, ink is introduced from the common flow path 4 into the pressure generating chamber 1 by the pressure generated by the surface tension of a meniscus 9. That is, if there does not occur a large difference in pressure between the nozzle 2 and the common flow path 4 due to the pressure generated by the surface tension of the meniscus 9, refilling cannot be carried out promptly. However, when there occurs a pressure drop in the common flow path 4 due to the concurrent and continuous ejection from the respective ejectors 10, the difference in pressure between the nozzle 2 and the common flow path 4 is reduced so that the refill speed is lowered.

Figure 16:
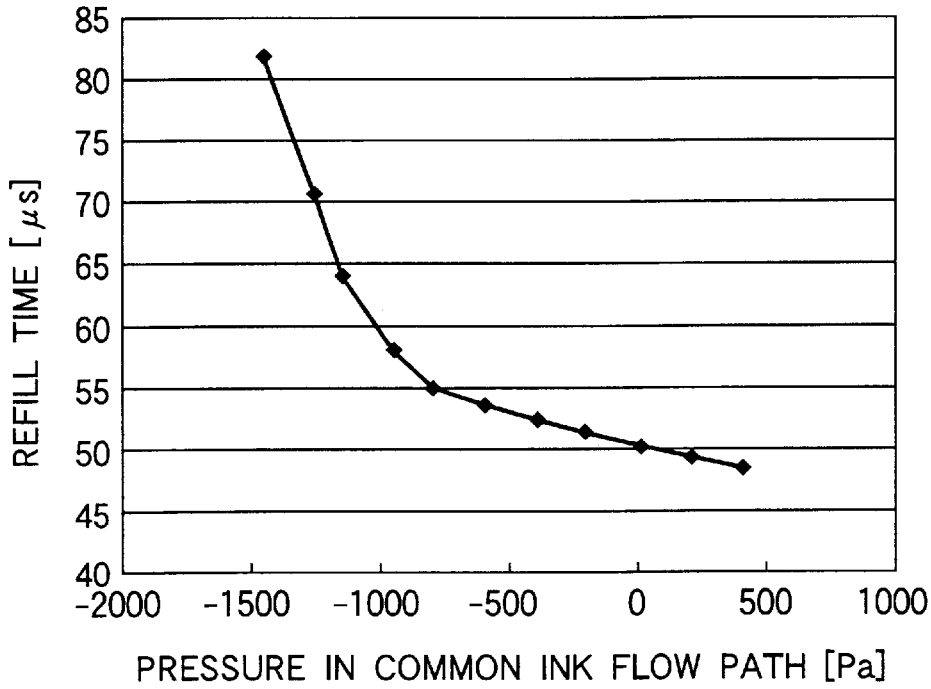
FIG. 16 is a graph showing the relationship between the pressure in a common flow path and the refill time.

FIG. 16 is a graph showing the result of experimental examination on the relationship between the pressure change ($\Delta P_p$) in the common flow path and the refill time ($t_r$) using the ink jet recording head according to this embodiment. It is proved that the refill time is substantially constant when the pressure drop in the common flow path 4 is not higher than 800 Pa, but the refill time increases suddenly when the pressure drop in the common flow path 4 is not lower than 800 Pa. Such a relationship between $\Delta P_p$ and $t_r$ changes in some degree in accordance with the surface tension of ink and the diameter of the nozzle. However, as a result of lots of analyses and experimental evaluations, it is made clear that in a general ink jet recording apparatus (surface tension 20–40 mN/m, nozzle diameter 15–40 $\mu$m), the lowering of the refill speed can be suppressed if the pressure drop in the common flow path is kept not higher than 800 Pa.

The magnitude of the pressure drop in the common flow path 4 may be obtained if pressure drops generated in the respective portions in the ink supply system are added. In the ink jet recording head according to this embodiment, assume that the number N of nozzles is 260, and ink droplets each having a droplet volume of 20 pl are ejected continuously from all the ejectors 10 at an ejecting frequency of 15 kHz. In this case, the total flow rate of ink is $7.8\times10^{-8}$ $m^3/s$. The flow path resistance of the ink tank 20 is $3.0\times10^{8}$ $Ns/m^5$, the flow path resistance of the ink conduit 18*a* is $2.3\times10^{7}$ $Ns/m^5$, and the flow path resistance of the filter 19 is $1.0\times10^{9}$ $Ns/m^5$. Therefore, the quantity of the pressure drop generated in the ink tank 20 is 23.4 Pa, the quantity of the pressure drop generated in the ink conduit 18*a* is 1.8 Pa, and the quantity of the pressure drop generated in the filter 19 is 78 Pa.

On the other hand, the ink conduits 18*b* are two branches. Therefore, the flow rate in each ink conduit 18*b* is $3.9\times10^{-8}$ $m^3/s$. The flow path resistance of the ink conduit 18*b* is $1.5\times10^{8}$ $Ns/m^5$. Thus, the quantity of the pressure drop generated in the ink conduit 18*b* is 5.9 Pa. In each of the two second common flow paths 16, the flow rate is $3.9\times10^{-8}$ $m^3/s$, and the flow path resistance r is $2.9\times10^{9}$ $Ns/m^5$. Thus, the quantity of the pressure drop is 113 Pa. Thirteen common flow paths 4 are connected to each second common flow path 16. Accordingly, the ink flow rate in each common flow path 4 is $0.3\times10^{-8}$ $m^3/s$. The flow path resistance r of the common flow path 4 is $1.9\times10^{11}$ $Ns/m^5$. Thus, the quantity of the pressure drop is 570 Pa. After all, when ink droplets each having a droplet volume of 20 pl are ejected from all the ejectors continuously at an ejecting frequency of 15 kHz in the ink jet recording head according to this embodiment, the pressure drop generated between the ink tank 20 and the common flow path 4 reaches 792 Pa, which is the total sum of the above calculated pressure drop quantities.

The flow path resistance of the ink supply system is set to be small thus in the ink jet recording head according to this embodiment. Accordingly, even if ink droplets each having a droplet volume of 20 pl are ejected from all the ejectors continuously at an ejecting frequency of 15 kHz, the pressure drop in each common flow path can be suppressed to be not higher than 800 Pa. It is therefore possible to prevent the refill time from increasing due to the pressure drop in the common flow paths, so that it is possible to carry out stable, continuous ejection at a high frequency.

Figure 17:
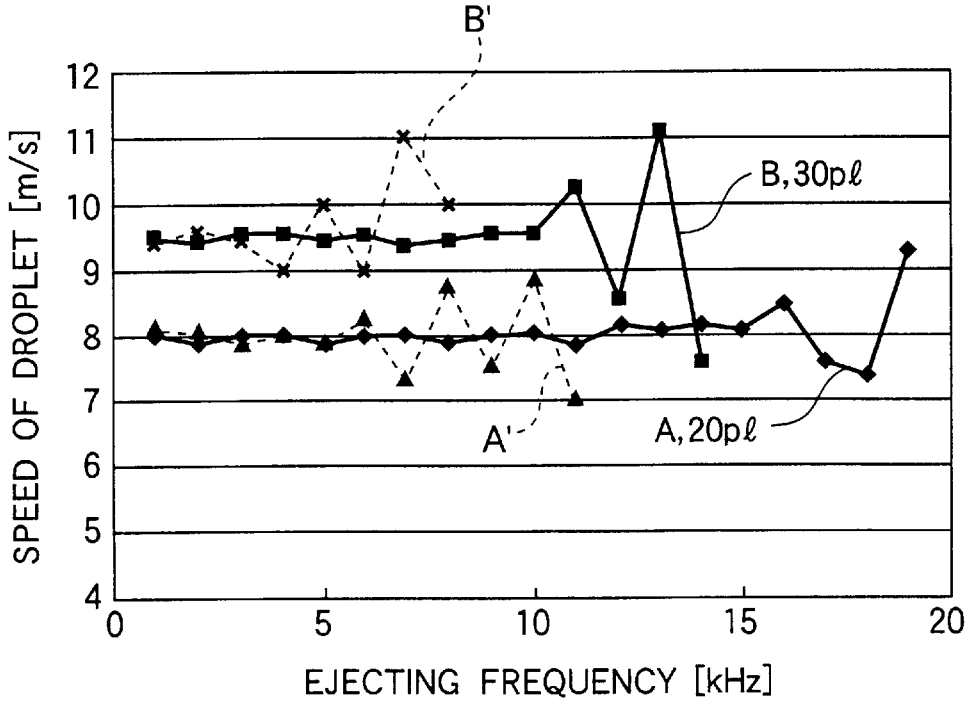
FIG. 17 is a graph showing the ejecting characteristic of the ink jet recording head according to the third embodiment.

FIG. 17 shows the result of examination on the stability of ejection in the ink jet recording head according to this embodiment, in which the ejecting frequency and the ejected ink droplet volume are varied. The stability of ejection is evaluated by the droplet speed of the ejected ink droplet 8. As shown in the graph, in the case (A) where the ink droplet volume is 20 pl, stable ejection can be attained up to about 16 kHz. In addition, it is confirmed that stable ejection can be obtained up to about 10 kHz even in the case (B) where the droplet volume is increased to 30 pl.

As a subject of comparison, the experimental result of ejection in the case where each common flow path 4 is changed to be 80 $\mu$m high is shown by the broken line (A') in FIG. 17. In this case, the flow path resistance of the common flow path 4 is $5.9\times10^{11}$ $Ns/m^5$. Thus, when ink droplets 8 each having a droplet volume of 20 pl are ejected from all the ejectors 10 continuously at an ejecting frequency of 15 kHz, the pressure drop in the common flow path 4 increases to about 2,000 Pa. In this case, the condition that the pressure drop in the common flow path is made not higher than 800 Pa cannot be satisfied. It is therefore confirmed also in the experimental result that the droplet speed becomes unstable at an ejecting frequency of 6 kHz or higher so that the droplet ejection becomes unstable. When the ejecting condition of the ink droplets 8 is observed stroboscopically, large-diameter droplets and small-diameter droplets are ejected alternately. In addition, in the case (B') where the droplet volume is increased to 30 pl, unstable droplet ejection is observed likewise at an ejecting frequency of 4 kHz or higher. Incidentally, even in this head, stable ejection can be attained in all the nozzles 2 at the time of low-frequency driving. The acoustic capacitance of the common flow path 4 can be regarded as sufficient.

From the above comparative experiment, it is confirmed that stable high-frequency ejection can not be attained if only the acoustic capacitance of the common flow path 4 is set to be large, and stable, concurrent and continuous ejection from all the nozzles can be attained only when the flow path resistance of the ink supply system is set suitably in accordance with the volume of ejected droplets, the number of nozzles and the maximum ejecting frequency.

In the description of this embodiment, the flow path resistance and the pressure drop quantity are calculated by use of the average length $l_p$ of the common flow paths 4 and the average length $l_{p'}$ of the second common flow paths 16. However, to obtain the pressure drop in each common flow path strictly, it is desired that the pressure drop is calculated by use of an equivalent circuit as shown in FIG. 15.

In this embodiment, the second common flow paths 16 are divided into the upper and the lower parts. This is to reduce the required width of the second common flow paths 16. That is, when the second common flow paths 16 are divided into two, the length $l_{p'}$ of each second common flow path 16 is reduced. Thus, the fluid resistance is hard to increase even when the width of the second common flow path 16 is set to be small. For example, when there is formed one second common flow path 16 as in the first embodiment, the length $l_{p'}$ of the second common flow path 16 is about 7 mm. Therefore, in order to make the fluid resistance of the second common flow path 16 equal to that in this embodiment ($2.9\times10^9$ Ns/m$^5$), it is necessary to expand the width of the second common flow path 16 to about 5.5 mm (in this embodiment, the width of each second common flow path 16 is 2.5 mm). That is, when the second common flow path 16 is divided into plural number as in this embodiment, the length $l_{p'}$ can be reduced so that the required width of each second common flow path 16 can be reduced on a large scale.

For improvement in the printing speed, reduction in the total head width ($W_H$) of the ink jet recording head is extremely important. That is, when the total width of the head is small, the travelling distance of the head at the time of printing can be made so short that the required time for the head to scan can be shortened. As a result, the printing speed can be reduced. In addition, when the total width of the head can be reduced, the spaces margined in the left and right of the sheet of recording paper can be reduced. Thus, there can be also obtained an effect that the size of the ink jet recording apparatus can be reduced.

In addition, it is advantageous to the improvement of the carriage accuracy of a recording medium (such as a recording paper) in the ink jet recording apparatus to dispose the second common flow paths by the sides of the ejector group. That is, in the ink jet recording apparatus, a recording medium is retained and carried by rollers or the like installed in front of and at the rear of the head. When the total length ($L_H$) of the head is large, the carriage accuracy of the recording medium is apt to deteriorate due to the deflection or the like of the recording medium between the rollers. It is therefore important to minimize the head length $L_H$. From such a point of view, it is desired to provide a head structure in which subsidiary streams of the common flow paths 4 are disposed substantially in parallel with the main-scanning direction while main streams of the common flow paths 4 are disposed by the sides of the ejector group, as in this embodiment.

Fourth Embodiment

Figure 18:
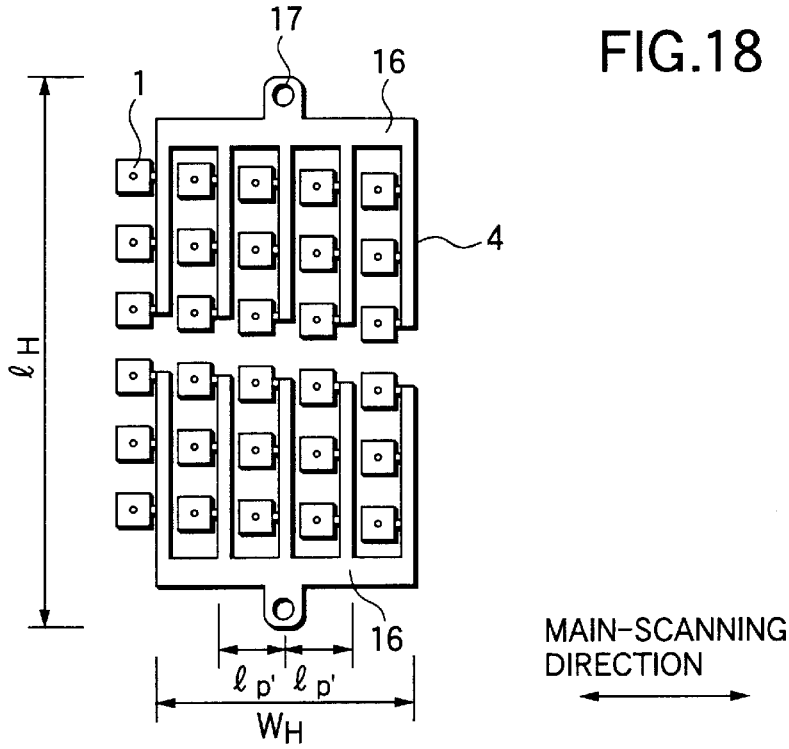
FIG. 18 is a view showing the arrangement of common flow paths in an ink jet recording head according to a fourth embodiment of the invention.

FIG. 18 schematically shows the arrangement of flow paths in a fourth embodiment of the invention. The ejector structure in this embodiment is the same as that in the third embodiment, except the arrangement of the common flow paths 4 and the second common flow paths 16. A feature is that the common flow paths 4 are disposed substantially perpendicularly to the main-scanning direction of the head while the second common flow paths 16 are disposed substantially in parallel with the main-scanning direction. According to such arrangement of the common flow paths 4, the second common flow paths 16 are not disposed at the sides of the ejector group. Thus, the head width in the main-scanning direction can be set to be small so that it is possible to attain an ink jet recording head more advantageous to recording at a high speed and reduction in apparatus size. The details will be described below.

The ink jet recording head according to this embodiment, as shown in FIG. 18, the common flow paths 4 are disposed substantially perpendicularly to the main-scanning direction, and connected to the second common flow paths 16 disposed substantially in parallel with the main-scanning direction. The common flow paths 4 are divided into an upper half part and a lower half part with the head center as the boundary therebetween. The upper half of the common flow paths 4 are connected to one of the second common flow paths 16 disposed in the upper portion, while the lower half of the common flow paths 4 are connected to the other of the second common flow paths 16 disposed in the lower portion.

The structure in which the common flow paths 4 are divided into a plurality of parts is advantageous to reduction in required sectional area of each common flow path. As described above, in order to attain stable concurrent ejection from a large number of nozzles at a high frequency, it is necessary to set the flow path resistance of the ink supply system to be small. It is therefore also necessary to set the flow path resistance of each common flow path 4 to be small. However, when the total length of the common flow path 4 is large, the flow path resistance cannot be set to be small unless the sectional area of the common flow path 4 is set to be very large. When the common flow paths are divided into the upper half part and the lower half part as shown in FIG. 18, the total length ($l_p$) of each common flow path can be shortened so that the flow path resistance of the common flow path 4 can be reduced even if the sectional area thereof is small.

The ejectors 10 are connected to each common flow path 4. The ejectors 10 are arrayed two-dimensionally. An ink supply port 17 is disposed in the central portion of each second common flow path 16 so that ink is supplied from an ink tank (not shown) through the ink supply port.

The second common flow paths are arranged thus on the upper and lower sides of the ejector group in the ink jet recording head according to this embodiment. Accordingly, the head width in the main-scanning direction can be set to be small in comparison with those in the ink jet recording heads according to the first to third embodiments. In this embodiment, the nozzle pitch $P_c$ is set at 600 $\mu$m. Thus, the head width in the main-scanning direction is about 6 mm. The head width could be reduced by 2–4 mm according to this embodiment, in comparison with the head width of 8–10 mm according to the first to third embodiments.

A plurality of ink jet recording heads are disposed in parallel in a practical ink jet recording apparatus. Thus, the total width of the heads can be reduced on a larger scale. For example, when four heads corresponding to the four colors of yellow, magenta, cyan and black are aligned, the total width of the heads can be reduced by about 8–16 mm in comparison with that in the first to third embodiments. In such a manner, the ink jet recording head according to this embodiment is extremely advantageous to improvement in printing speed and reduction in apparatus size because the total head width can be reduced.

Fifth Embodiment

Figure 19:
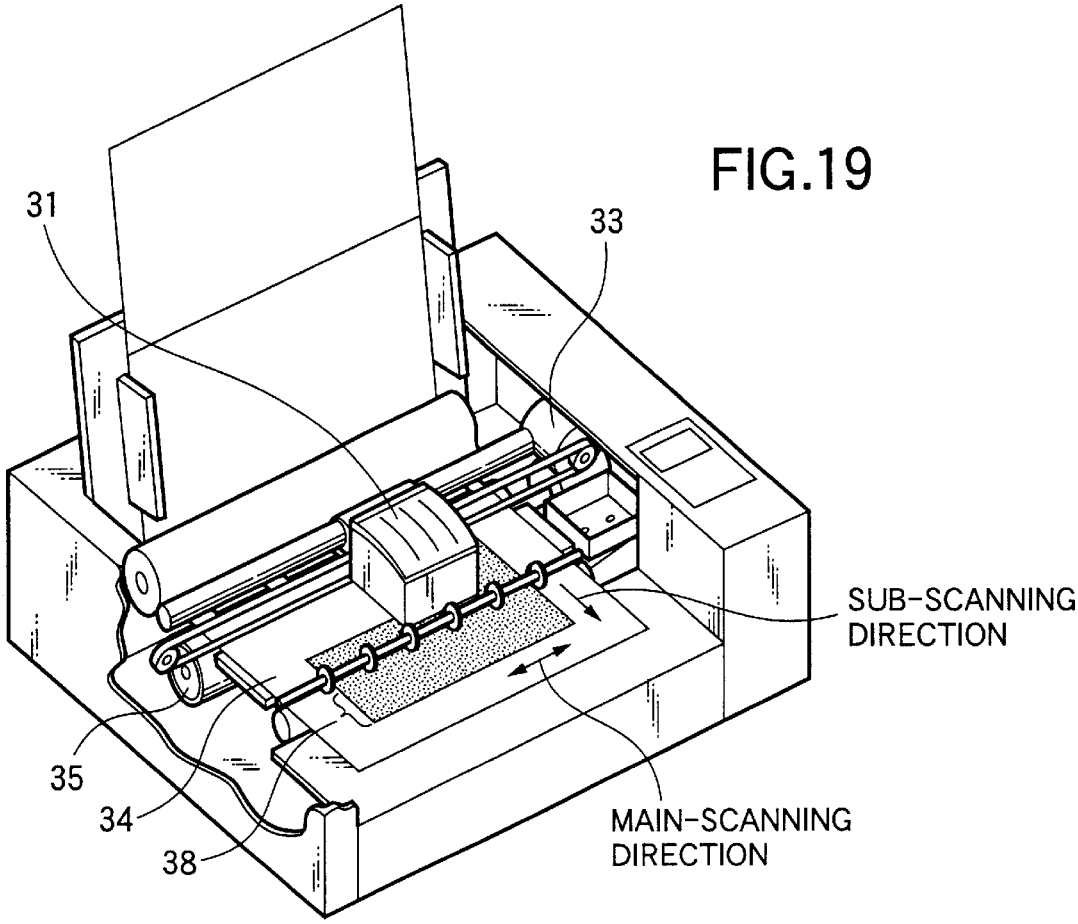
FIG. 19 is a view showing an embodiment of an ink jet recording apparatus according to the invention.

FIG. 19 shows an embodiment of an ink jet recording apparatus according to the invention. The ink jet recording apparatus according to this embodiment is constituted by a carriage 31 mounted with ink jet recording heads, a main-scanning mechanism 33 for conveying the carriage 31 to scan in the main-scanning direction, and a sub-scanning mechanism 35 for conveying a recording paper 34 as a recording medium in the sub-scanning direction.

The ink jet recording heads are mounted on the carriage 31 so that their nozzle surfaces face the recording paper 34. The ink jet recording heads eject ink droplets 8 onto the recording paper 34 while being conveyed in the main-scanning direction. Thus, the ink jet recording heads perform recording on a fixed band area 38. Next, the recording paper 34 is conveyed in the sub-scanning direction, and the carriage 31 is conveyed again in the main-scanning direction. Thus, recording is performed on the next band area. Such an operation is repeated a plurality of times so that an image can be recorded on the whole surface of the the recording paper 34.

Practically, images are recorded by use of the ink jet recording apparatus according to this embodiment, and the recording speed and the image quality are evaluated. The head structure described in the third embodiment is adopted in each of the ink jet recording heads. The nozzle pitch $P_c$ is 500 $\mu$m, and the number of nozzles per $mm^2$ is 3.3. The matrix-array heads corresponding to the four colors of yellow, magenta, cyan and black and having 260 ejectors for each color are arranged in parallel on the carriage 31. Dots of the four colors are superimposed on the recording paper 34. Thus, full-color images are recorded.

An A4-size (210 mm by 297 mm) image is printed on the conditions of a droplet volume of 20 pl, a recording resolution of 600 dpi and an ejecting frequency of 18 kHz. As a result, the printing can be completed in about 5 seconds. Thus, it is proved that an extremely high recording speed can be attained. In addition, acoustic crosstalk or unstable ejection phenomena at the time of concurrent ejection from multiple nozzles can be suppressed so that very high image quality can be obtained in the output image.

As a comparative example, a similar image output test is performed by use of related-art heads each having straight common flow paths 4. In this case, the nozzle pitch Pc has to be set at 850 $\mu$m in order to secure sufficient acoustic capacitance in each common flow path 4. As a result, the upper limit of the number of nozzles that can be arrayed in the same head area is 150 (the number of nozzles per $mm^2$ is 2.0). Therefore, it takes about 9 seconds to record an A4-size (210 mm by 297 mm) image. That is, the recording speed is about ½ of that in the ink jet recording apparatus according to this embodiment.

As another comparative example, a similar image output test is performed by use of ink jet recording heads each having a related-art head structure having straight common flow paths 4. The nozzle pitch $P_c$ in the related-art ink jet recording heads is set at 500 $\mu$m as small as that in this embodiment. In this case, 260 nozzles per color can be indeed secured in the same manner as in this embodiment, but the acoustic capacitance $c_p$ of each common flow path 4 does not satisfy the conditions of the expressions (5) and (7) because the width of the common flow path is small to be 150 $\mu$m. An A4-size (210 mm by 297 mm) image is printed on the conditions of a droplet volume of 20 pl, a recording resolution of 600 dpi and an ejecting frequency of 18 kHz. As a result, the printing can be completed in about 5 seconds. However, the ejecting condition of the ink droplets 8 is very unstable, and a large number of nozzles incapable of ejecting ink droplets appear during the image output. Thus, the quality of the output image is extremely bad. That is, it is proved that stable ink droplet ejection can not be carried out when the array density of the nozzles 2 is increased by force in the related-art head structure.

As described above, since the common flow paths are formed into constricted portions in the ink jet recording apparatus according to this embodiment, the nozzle array density (the number of nozzles per unit area) can be increased while keeping stable ejection stability. Thus, the recording speed can be increased on a large scale in comparison with that in the related-art ink jet recording apparatus.

Incidentally, this embodiment adopts the form in which recording is performed while the heads are conveyed by the carriage. However, the invention can be applied to other apparatus forms. For example, by use of linear heads in which nozzles are disposed all over the full width of a recording medium, recording can be performed on the recording medium in the condition that the recording medium is conveyed while the heads are fixed.

Description has been made above on the embodiments of the invention. However, the embodiments show the preferred modes for carrying out the invention, and the invention is not limited to the embodiments. That is, various changes, improvements, modifications, simplifications, and the like, may be added to the embodiments so as to obtain other forms. Thus, the invention may be carried out by use of such other forms without departing from the gist of the invention.

For example, although piezoelectric actuators are used as pressure generating members in the embodiments, other pressure generating members such as electromechanical transducers using electrostatic force or magnetic force, or electrothermal transducers for generating pressure using a boiling phenomenon, may be used. In addition, as the piezoelectric actuators, the single-plate type piezoelectric actuators used in the embodiments may be replaced by other types of actuators such as longitudinal oscillation type laminated piezoelectric actuators.

In addition, although flow paths are formed by lamination of a plurality of plates in the embodiments, the configuration, material and so on of the plates are not limited to those in the embodiments. Although the nozzle plate or the supply path plate is used as the air damper for the common flow paths in the embodiments, the invention is applicable to heads having another plate configuration. For example, a dedicated plate for forming an air damper may be inserted. In addition, the invention is applicable likewise to heads having flow paths molded integrally out of ceramics, glass, resin, silicon, or the like.

Figure 20:
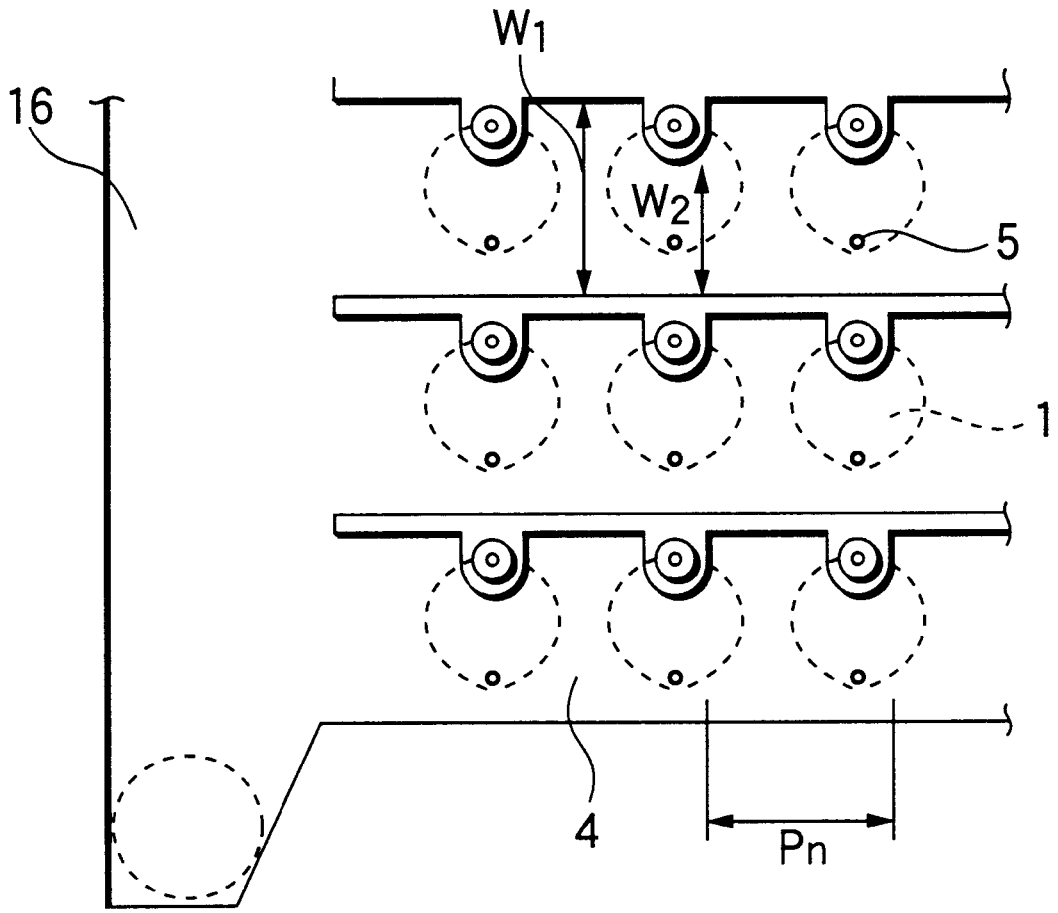
FIG. 20 is a view showing the planar shape of the ink jet recording head according to the first embodiment.

In addition, the shape of each common flow path is not limited to a shape of the common flow path shown in FIG. 5, which has constricted portions (steps) on its opposite side walls. Similar effect can be obtained by use of other shapes. For example, constricted portions may be provided on only one side of each common flow path as shown in FIG. 20.

Figure 21A:
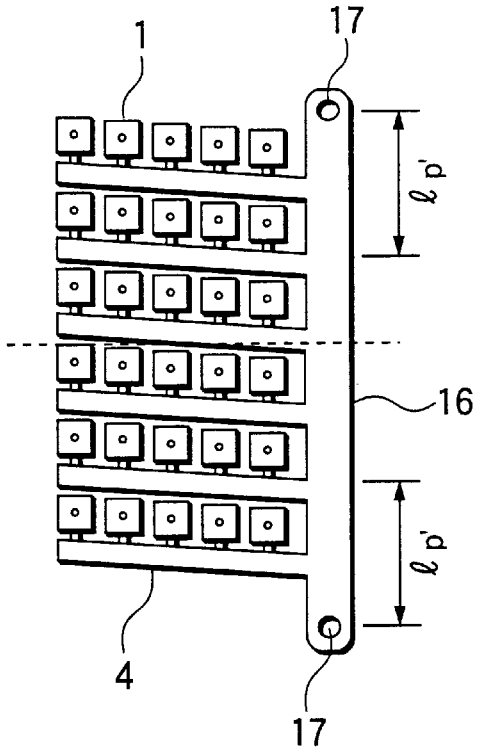
FIG. 21 is views showing the configuration of the ink supply system according to the third embodiment.
Figure 21B:
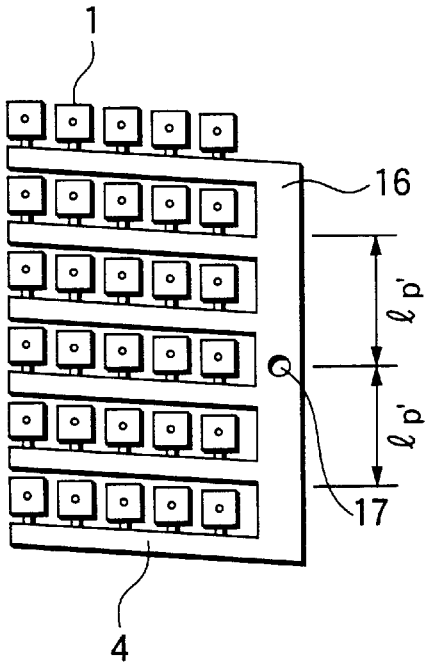
Figure 21C:
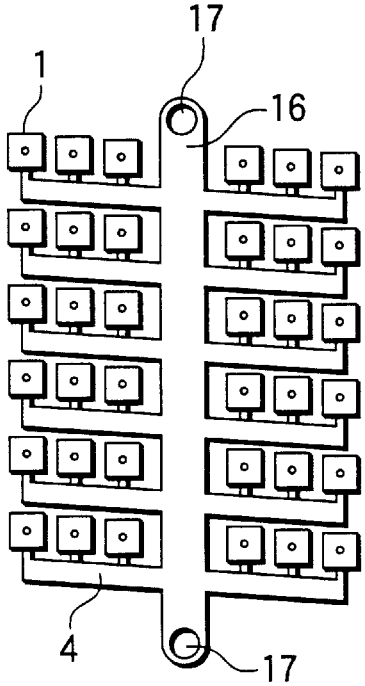

In addition, as for the common flow path configuration, configurations shown in FIGS. 21A to 21C maybe adopted in place of the configuration of FIG. 14. FIG. 21A shows an example in which a second common flow path is not divided into the upper half part and the lower half part, and ink supply ports are provided in the opposite ends of the second common flow path. Also in this case, the length $l_{p'}$ of the second common flow path is regarded as equal to that in FIG. 14. In addition, in the flow path configuration of FIG.

21A, ink is supplied to the second common flow path from two directions. Thus, there is an effect that a failure in ejection can be prevented even if the second common flow path is partially clogged with dust or the like.

In addition, FIG. 21B shows an example in which an ink supply port is provided in the central portion of the second common flow path. Also in this case, the length $l_{p'}$ of the second common flow path is regarded as equal to that in FIG. 14. In addition, in this flow path configuration, since only one ink supply port is provided, the structure of the ink supply system can be simplified advantageously to reduction in head cost or the like. In addition, FIG. 21C shows an example in which common flow paths are interconnected with the both sides of a second common flow path. In this case, the length of each common flow path can be made half. Thus, there is obtained an effect that the required sectional area of the common flow path can be reduced. Incidentally, the common flow path configuration shown in FIG. 21 show preferred embodiments of the invention, but other common flow path configurations may be adopted.

Figure 22A:
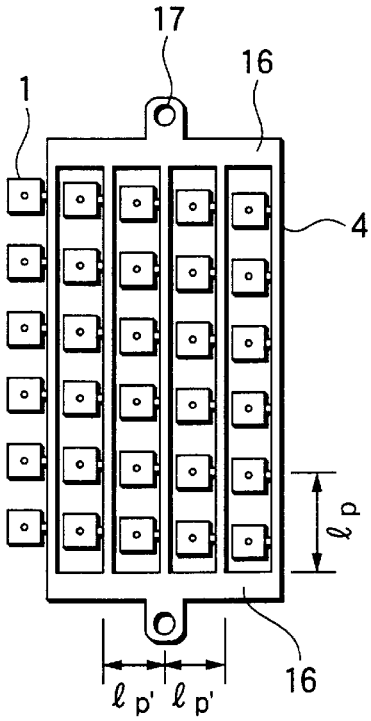
FIG. 22 is views showing the arrangement of common flow paths in the ink jet recording head according to the fourth embodiment.
Figure 22B:
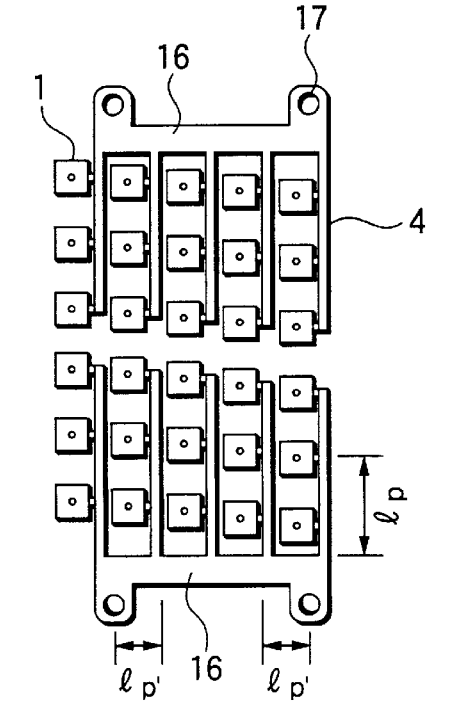
Figure 22C:
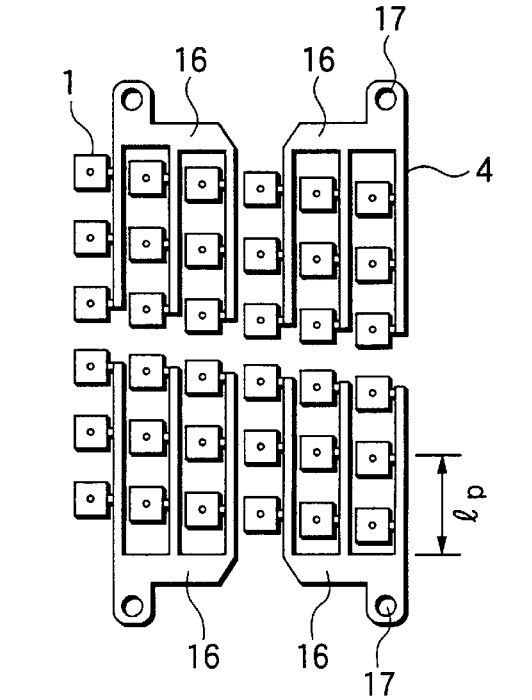
Figure 23:
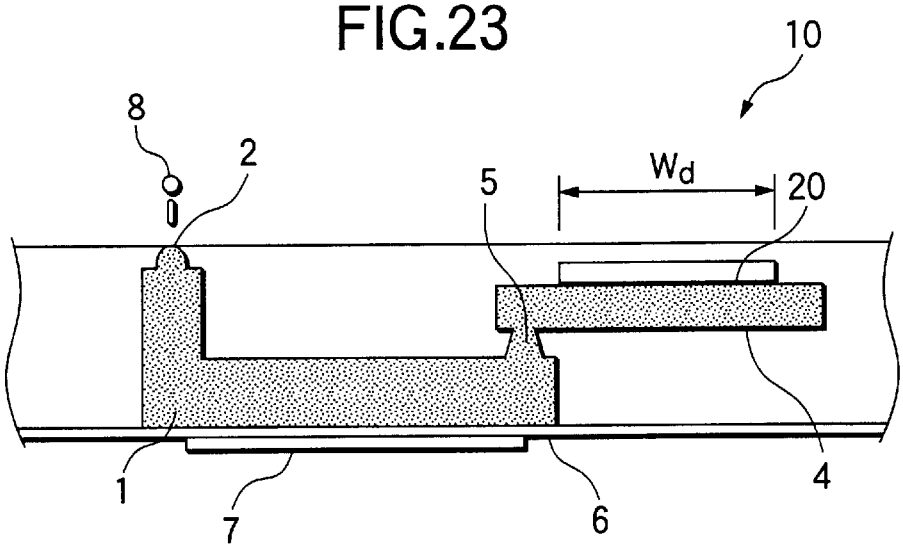
FIG. 23 is a sectional view showing the basic structure of a related-art ink jet recording head.
Figure 24A:
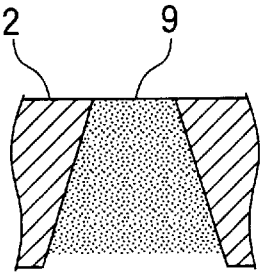
FIG. 24 is schematic views for explaining the behavior of a meniscus when an ink droplet is ejected.
Figure 24B:
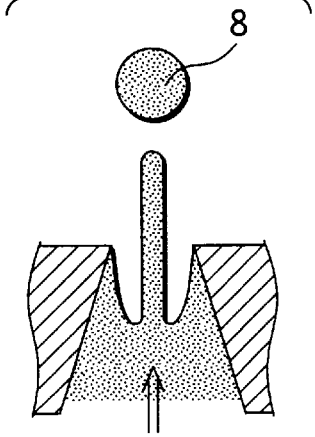
Figure 24C:
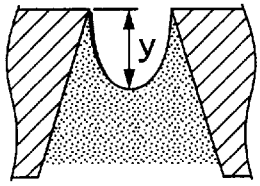
Figure 24D:
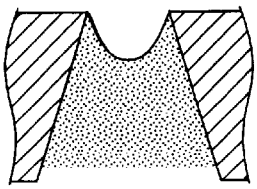
Figure 24E:
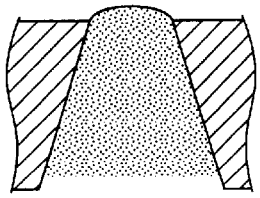
Figure 24F:
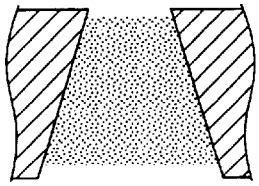
Figure 25:
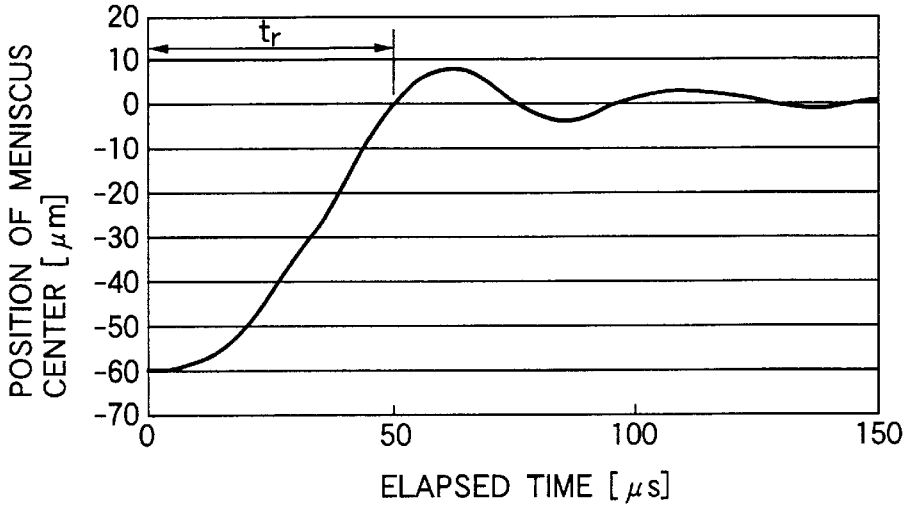
FIG. 25 is a graph showing the positional change of the meniscus at the time of refill.
Figure 26:
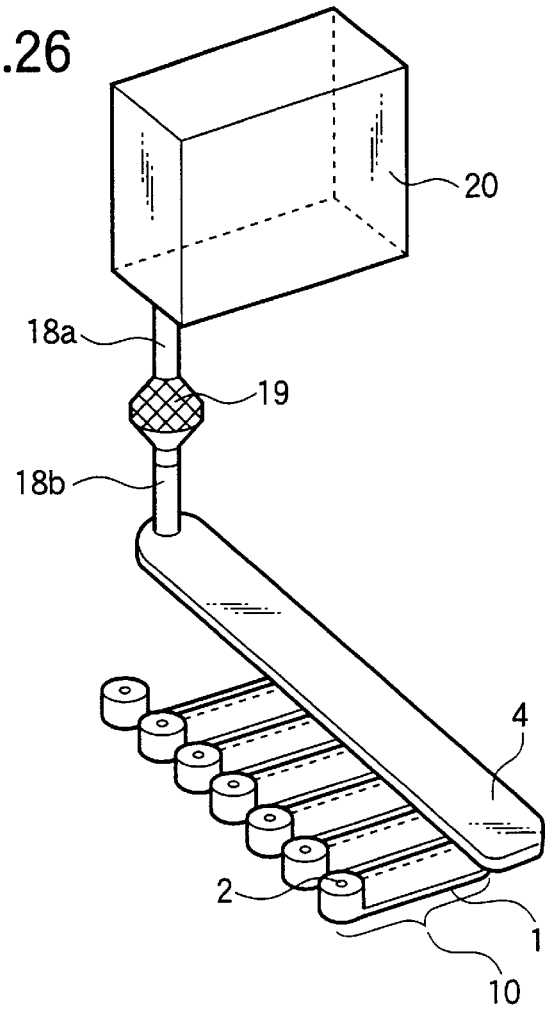
FIG. 26 is a view showing the basic structure of a multi-nozzle type ink jet recording head.
Figure 27:
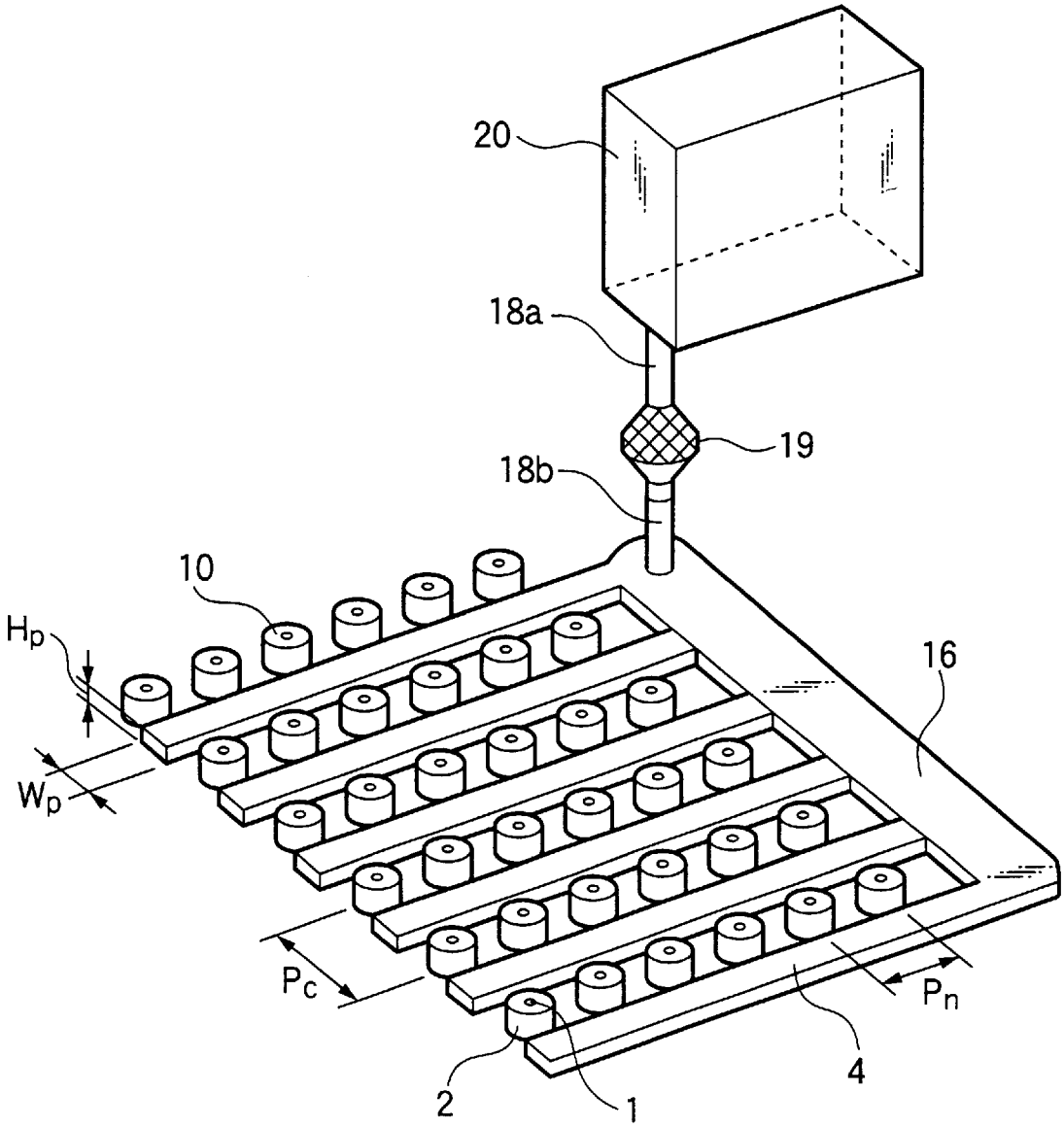
FIG. 27 is a view showing the basic structure of a matrix-array type ink jet recording head.

In addition, as for the common flow path configuration, configurations shown in FIGS. 22A to 22C may be adopted in place of the configuration of FIG. 18. FIG. 22A shows an example in which common flow paths 4 are not divided into the upper half part and the lower half part, and the opposite ends of each common flow path 4 are connected to second common flow paths 16. In this case, ink is supplied to the common flow paths 4 from two directions. Thus, there is an effect that a failure in ejection can be prevented even if the common flow paths are partially clogged with dust or the like.

In addition, FIG. 22B shows an example in which two ink supply ports 17 are provided in each of second common flow paths 16 disposed in the upper and lower portions. In this case, the length $l_{p'}$ of each second common flow path can be reduced so that the required width of the second common flow path can be reduced. Thus, there can be obtained an effect that the total head length in the sub-scanning direction can be reduced. The reduction in total head length is advantageous to achievement of stable paper conveyance as described previously.

In addition, FIG. 22C shows an example in which common flow paths 4 and second common flow paths 16 divided into the upper half part and the lower half part are divided into two respectively. In this case, in the same manner as in FIG. 22B, there is an effect that the required width of each second common flow path can be reduced so that the total head length in the sub-scanning direction can be reduced. Further, a stagnation point (portion where the flow rate is low) of ink can be prevented from occurring in the common flow paths and the second common flow paths, advantageously to suppression of bubbles staying in the common flow paths and the second common flow paths. Incidentally, the common flow path configurations shown in FIG. 22 show preferred embodiments of the invention, but other common flow path configurations may be adopted.

In addition, although the shape of each pressure generating chamber is formed into a quadrangular shape in the embodiments, other shapes such as a circular shape or a hexagonal shape may be adopted as the shape of the pressure generating chamber. Further, although the nozzles are arranged in a substantially lattice-like shape in the embodiments, the nozzle arrangement is not limited to such a substantially lattice-like shape. The invention is also applicable to the case using any other two-dimensional arrangement method.

In addition, although the embodiments have described on the case where ink jet recording heads and an ink jet recording apparatus are used, by way of example, for ejecting colored ink onto a recording paper so as to record characters or graphics thereon, ink jet recording in this specification is not limited to recording of characters or graphics on a sheet of recording paper. That is, recording media are not limited to paper, and fluid to be ejected is not limited to colored ink. The invention may be used for a general droplet injection apparatus used industrially. For example, colored ink may be ejected onto a polymer film or a glass plate so as to manufacture a color filter for a display, or molten solder may be ejected onto a substrate so as to form bumps for mounting parts on the substrate.

As described above, according to the invention, a matrix-array head having a high nozzle array density can be produced, and an ink jet recording head and an ink jet recording apparatus having an extremely high recording speed can be produced.

In addition, according to the invention, acoustic crosstalk through any common flow path or unstable ejection phenomena occurring at the time of concurrent ejection from multiple nozzles can be prevented so that an ink jet recording head and an ink jet recording apparatus superior in uniformity and stability of the ejecting characteristic can be produced.

Further, according to the invention, bubbles can be prevented from staying in common flow paths, so that a matrix-array head and an ink jet recording apparatus having high reliability can be produced.

What is claimed is:

1. An ink jet recording head comprising:
   - a plurality of ejectors arrayed two-dimensionally, each including:
     - a pressure generating chamber;
     - a nozzle communicating with said pressure generating chamber; and
     - a pressure generating portion; and
   - an ink supply system including a common flow path interconnecting the plurality of ejectors,
   - wherein ink is charged into said pressure generating chambers through said common flow path;
   - a change of pressure is generated in said ink in said pressure generating chamber by said pressure generating portion;
   - ink droplets are ejected from said nozzles;
   - said common flow path is disposed to overlap said pressure generating chambers two-dimensionally; and
   - said common flow path has a constricted shape having wide portions and narrow portions.

2. An ink jet recording head according to claim 1, wherein said common flow path is formed to be narrow between said nozzles adjacent to each other through said common flow path and to be wide in any other portion.

3. An ink jet recording head according to claim 1, wherein a member forming said nozzles also serves as an air damper for said common flow path.

4. An ink jet recording head according to claim 1, wherein a member forming said nozzles is made of a resin film.

5. An ink jet recording head according to claim 1, wherein said ink jet recording head is formed so that acoustic capacitance $c_p$ of said common flow path satisfies $c_p>20c_c$ where $c_c$ designates acoustic capacitance of each of said pressure generating chambers.

6. An ink jet recording head according to claim 1, wherein said ink jet recording head is formed so that acoustic capacitance $c_p$ of said common flow path satisfies $c_p>10c_n$ when $c_n$ designates acoustic capacitance of each of said nozzles.

7. An ink jet recording head according to claim 1, wherein flow path resistance of said ink supply system is set so that refill time when ink droplets are ejected continuously from said nozzles is prevented from being longer than an intended ejection period due to a drop in pressure in said common flow path caused by a quasi-stationary ink flow in said ink supply system.

8. An ink jet recording head according to claim 7, wherein said flow path resistance of said ink supply system is set so that said drop in pressure in said common flow path when ink droplets are ejected continuously from said nozzles is not higher than 800 Pa.

9. An ink jet recording head according to claim 1, wherein a planar shape of said common flow path corresponding to said constricted shape is formed out of a smooth curve.

10. An ink jet recording head according to claim 1, wherein said ink supply system includes:

a plurality of common flow paths; and a second common flow path for making the plurality of common flow paths interconnect with one another.

11. An ink jet recording head according to claim 10, further comprising:

an ink supply port for supplying ink to said second common flow path, wherein said ink supply port is provided near a center of said second common flow path.

12. An ink jet recording head according to claim 10, further comprising:

a plurality of ink supply ports for supplying ink to said second common flow path, wherein a plurality of the ink supply ports is provided for each second common flow path.

13. An ink jet recording head according to claim 10, wherein said second common flow path is a plurality of second common flow paths.

14. An ink jet recording head according to claim 13, wherein:

said plurality of common flow paths are divided into two or more groups; and said respective groups of said common flow paths are connected to said second common flow paths different from one another.

15. An ink jet recording head according to claim 10, wherein:

said common flow paths are disposed substantially in parallel with a main-scanning direction of said ink jet recording head; and said second common flow path is disposed substantially perpendicularly to said main-scanning direction.

16. An ink jet recording head according to claim 10, wherein:

said common flow paths are disposed substantially perpendicularly to a main-scanning direction of said ink jet recording head; and said second common flow path is disposed substantially in parallel with said main-scanning direction.

17. An ink jet recording apparatus comprising an ink jet recording head including:

a plurality of ejectors arrayed two-dimensionally, each including:

a pressure generating chamber;

a nozzle communicating with said pressure generating chamber; and a pressure generating portion; and an ink supply system including a common flow path for interconnecting a plurality of said ejectors therewith;

wherein:

ink is charged into said pressure generating chambers through said common flow path;

a change of pressure is generated in said ink in said pressure generating chambers by said pressure generating portions corresponding thereto;

ink droplets are ejected from said nozzles;

said common flow path is disposed to overlap said pressure generating chambers two-dimensionally; and said common flow path has a constricted shape having wide portions and narrow portions.

* * * * *